US012116724B2

(12) United States Patent
Mendes

(10) Patent No.: US 12,116,724 B2
(45) Date of Patent: Oct. 15, 2024

(54) LAUNDRY RETRIEVAL AND INSERTION TOOL AND METHOD OF USING SAME

(71) Applicant: Eric Ricardo Mendes, Vancouver (CA)

(72) Inventor: Eric Ricardo Mendes, Vancouver (CA)

( * ) Notice: Subject to any disclaimer, the term of this patent is extended or adjusted under 35 U.S.C. 154(b) by 0 days.

(21) Appl. No.: 18/660,168

(22) Filed: May 9, 2024

(65) Prior Publication Data

US 2024/0287731 A1 Aug. 29, 2024

Related U.S. Application Data

(63) Continuation-in-part of application No. PCT/IB2023/051996, filed on Mar. 3, 2023, and a continuation-in-part of application No. 18/099,524, filed on Jan. 20, 2023, which is a continuation of application No. 17/869,585, filed on Jul. 20, 2022, now Pat. No. 11,572,655.

(60) Provisional application No. 63/316,728, filed on Mar. 4, 2022.

(51) Int. Cl.
*D06F 95/00* (2006.01)

(52) U.S. Cl.
CPC ..... *D06F 95/002* (2013.01)

(58) Field of Classification Search
CPC ..... D06F 95/002; D06F 95/00; D06F 95/004; D06F 95/006; D06F 95/008; B65D 33/02
See application file for complete search history.

(56) References Cited

U.S. PATENT DOCUMENTS

| | | | | |
|---|---|---|---|---|
| 2,150,620 | A | 3/1939 | Frost | |
| 3,107,712 | A | 10/1963 | Adelmo | |
| 3,747,653 | A * | 7/1973 | Ringer | B65B 67/1238 15/257.1 |
| 3,769,819 | A | 11/1973 | Contreras | |
| 3,771,752 | A | 11/1973 | Meeh | |
| 4,290,468 | A | 9/1981 | Rosenbloom, III et al. | |
| 4,388,739 | A | 6/1983 | Dayme | |
| 4,815,784 | A * | 3/1989 | Zheng | B60J 1/2091 160/370.21 |
| 4,832,292 | A * | 5/1989 | Beckham | B65B 67/1238 141/390 |
| 5,011,103 | A * | 4/1991 | Hayes | B65B 67/1255 383/33 |
| 5,213,147 | A * | 5/1993 | Zheng | B60R 5/045 296/37.16 |

(Continued)

*Primary Examiner* — Don M Anderson
(74) *Attorney, Agent, or Firm* — Invention To Patent Services; Alex Hobson

(57) ABSTRACT

A laundry retrieval device enables a method of inserting and method of retrieving laundry from a laundry machine using gravity to facilitate the process. The drum of the laundry machine is rotated to cause laundry to fall out of the laundry retrieval device for insertion and onto the laundry retrieval device for retrieval. An exemplary laundry retrieval device has a panel of material that extends within a resilient and flexible hoop component. The panel drapes within the hoop and one or more apertures between the panel and the hoop component forms handles for picking up and manipulating the laundry retrieval device. The hoop component is resilient and flexible to enable the laundry retrieval device to be folded around the laundry for insertion through the door opening and retrieval through the door opening of a laundry machine.

17 Claims, 45 Drawing Sheets

(56) References Cited

U.S. PATENT DOCUMENTS

| | | | | |
|---|---|---|---|---|
| 5,671,479 | A * | 9/1997 | Dedrick | A47G 23/06 2/259 |
| 5,927,793 | A * | 7/1999 | McGrath, Jr. | B60J 11/00 160/370.21 |
| 5,960,983 | A | 10/1999 | Chung | |
| 5,964,533 | A | 10/1999 | Ziglar | |
| 6,029,847 | A | 2/2000 | Lyons et al. | |
| 6,053,459 | A | 4/2000 | Priefert et al. | |
| 6,212,792 | B1 | 4/2001 | Bier | |
| 6,558,037 | B2 | 5/2003 | Gonella | |
| 7,228,646 | B1 * | 6/2007 | Purcell | D06F 58/04 34/104 |
| 7,815,372 | B2 | 10/2010 | Ghee et al. | |
| 8,910,857 | B1 | 12/2014 | Hegarty | |
| 9,828,721 | B2 | 11/2017 | Cavalcanti et al. | |
| 10,866,027 | B2 * | 12/2020 | Bucko | D06F 58/00 |
| 11,235,891 | B2 * | 2/2022 | Schmidt | B64C 39/024 |
| 11,572,655 | B1 * | 2/2023 | Mendes | D06F 95/002 |
| 2004/0155038 | A1 * | 8/2004 | Smith | B65D 37/00 220/826 |
| 2005/0103951 | A1 * | 5/2005 | Metcalfe | B65B 67/1238 15/257.1 |
| 2005/0284866 | A1 | 12/2005 | Oakner et al. | |
| 2008/0226205 | A1 | 9/2008 | Sillik | |
| 2015/0048081 | A1 * | 2/2015 | Youssef | D06F 95/002 220/4.01 |
| 2015/0203283 | A1 * | 7/2015 | Speckmann | B65D 85/18 220/4.01 |
| 2016/0347502 | A1 * | 12/2016 | Quinn | B65D 25/2852 |
| 2017/0327997 | A1 | 11/2017 | Florence | |
| 2020/0048824 | A1 * | 2/2020 | Bachoo | B65D 1/225 |
| 2020/0157733 | A1 * | 5/2020 | Holderness | B65D 21/08 |
| 2020/0240707 | A1 * | 7/2020 | Bucko | E04H 15/00 |
| 2023/0279609 | A1 * | 9/2023 | Mendes | D06F 95/002 220/9.2 |

* cited by examiner

LAUNDRY RETRIEVAL AND INSERTION TOOL AND METHOD OF USING SAME

CROSS REFERENCE TO RELATED APPLICATIONS

This application is a continuation of U.S. patent application Ser. No. 18/099,524, filed on Jan. 20, 2023 and currently pending, which is a continuation of U.S. patent application Ser. No. 17/869,585, filed on Jul. 20, 2022 and issued as U.S. Pat. No. 11,572,655 on Feb. 7, 2023, which claims the benefit of priority to U.S. provisional patent application No. 63/316,728, filed on Mar. 4, 2022, and this application is a continuation in part of PCT/IB2023/051996, filed on Mar. 3, 2023; the entirety of all prior applications are hereby incorporated by reference herein.

BACKGROUND OF THE INVENTION

Field of the Invention

The invention relates to a laundry retrieval device and a method of inserting and a method of retrieving laundry from a laundry machine using said device.

Background

Laundry is a routine task that requires placing laundry in a laundry machine (washer or dryer) and then retrieving the laundry from the laundry machine. The laundry is typically moved from the laundry washing machine to a laundry dryer machine. Recently, front-loaded laundry machines became very popular and this requires inserting and retrieving the laundry through the opening on a side, such as the front, of the laundry machine. The door opening is often configured close to the floor, thereby requiring the person to bend or kneel down to insert or retrieve the laundry from the laundry machine. Also, in most cases not all of the laundry can be retrieved or inserted at one time and therefore the process requires multiple steps. Laundry machines often have laundry that can be stuck behind or on-top of a flange extending up from the drum surface. It can be difficult to see these pieces of laundry and they can be left in the laundry machine which can cause problems with subsequent laundry cycles, especially if the piece left behind is a "dark" piece of laundry and "whites" are a subsequent load. The "dark" piece of laundry can dye the "whites".

SUMMARY OF THE INVENTION

The invention is directed to a laundry retrieval device and method of inserting and method of retrieving laundry from a laundry machine using said laundry retrieval device and gravity to facilitate the process. The drum of the laundry machine is rotated to cause laundry to fall out of the laundry retrieval device for insertion and onto the laundry retrieval device for retrieval. An exemplary laundry retrieval device is configured to facilitate inserting and retrieving laundry from a laundry machine, such as a laundry washer machine or laundry dryer machine, and particularly for front-loaded laundry machines having a door opening on a side of the laundry machine, such as the front side of the laundry machine. An exemplary laundry retrieval device has a panel of material that extends within a resilient and flexible hoop component. The panel drapes within the hoop and one or more apertures between the panel and the hoop component forms handles for picking up and manipulating the laundry retrieval device.

An exemplary hoop component is resilient and flexible wherein it enables the laundry retrieval device to be folded to place a first side in contact with an opposing second side of the hoop component and then return back to a hoop shape after being folded. In an exemplary embodiment, the hoop component is resilient and flexible to enable the laundry retrieval device to be collapsed into a collapsed laundry retrieval device having two or more spiral hoops. The spiral hoops may have a diameter that is about half the diameter of the laundry retrieval device thereby making storage of the laundry retrieval device easier and more convenient. The laundry retrieval device may comprise a pouch to retain the collapsed laundry retrieval device in a collapsed form. The pouch may be separate from the laundry retrieval device or may be attached to the laundry retrieval device, such as to the hoop component and may be an extension of the panel and may be made out of the same material as the panel.

An exemplary hoop component may be made out of a material that is resilient and flexible, such that is can be folded and then return to an unfolded shape upon removal of a force. The hoop component may be made out of metal, such as a spring steel, or may be made out of a polymer that is resilient and flexible, as defined herein. The hoop component may be made out of an elastomeric material, such as urethane, or silicone for example. An elastomeric material is a material that can be deformed and will return to a pre-deformed shape of form upon removal of the deforming force. A cover may be configured on the hoop component to protect the hoop component and to make it more comfortable to handle. The hoop component may be exposed in the handle area as described later herein. The hoop component may have a circular cross-sectional shape or rectangular cross-sectional shape.

A hoop component may have a plurality of extensions, such as a first extension that is coupled with a pivot or pair of pivots to enable the first extension to pivot with respect to the rest of the hoop component. In an exemplary embodiment a first extension of the hoop component and a second extension of a hoop component may be coupled with a pivot and both rotate or pivot about said pivot or pivots. A hoop component may be rigid when having a pivoting configuration, whereby the hoop component may be collapsed in dimension by rotation about a pivot for insertion into a laundry machine. A rigid hoop component may be a rod or cylinder of metal, a tube of metal as an example.

The hoop component may have a hoop cover configured around the hoop component to provide a more comfortable handle for handling the laundry retrieval device. The hoop component may be metal and may have a rectangular cross-section with square corners that may be uncomfortable to handle, especially when carrying heavy loads of laundry or when collapsing the laundry retrieval device. The hoop cover may extend completely around the hoop component and may be a tube forming a cover sleeve for receiving the hoop component. The hoop component and the hoop cover may be separate and not attached, such as by an adhesive, wherein there is a gap between the hoop component and the hoop cover. The hoop component may be a soft material and may be resilient such as a foam, or fabric. A foam material may be preferred as it is lightweight and provides comfort for handling the laundry retrieval device.

The panel material may extend continuously across and within the hoop component with no other supports or components within the interior of the hoop component or ring. Put another way, the interior of the hoop component may consist of the panel material only. The panel may be a fabric, such as a woven fabric that extends within the hoop and is attached to the hoop. A sleeve may be formed in the panel material and the hoop component may extend through this sleeve. The panel material may be elastic as defined herein and may be flexible or have an elongation to allow it to stretch to accommodate the laundry resting thereon. The panel fabric may stretch to form a bowl shape to retain the laundry within the laundry retrieval device. The panel material may have an elongation of at least 50% or more, or about 70% or more, or even 100% or more at 70% of max load to accommodate loads of laundry. This elongation parameter may be evaluated with a 25.4 mm wide by 152.4 mm long sample configured with the length extending between the jaws of the Instron, Instron Inc. Norwood MA, having a gap distance of 50.8 mm and with the strain rate of 10 mm/sec.

The panel material may be a non-elastic fabric, especially in embodiments wherein the panel forms a panel sack, which may be a cylindrical panel extending from the hoop component. A panel sack may be configured to extend down into a retainer, such as a cylindrical retainer and the hoop component may be configured to rest on a top of said retainer, or be otherwise coupled with the retainer to configure the panel sack down into the retainer. A panel sack may have a length from the hoop portion to a base of the panel sack of about 0.4 m or more, about 0.5 m or more, about 0.6 m or more, about 0.75 m or more, about 0.9 m or more, about 1 m or more and any range between and including the length values provided, such as from about 0.4 m to about 1.0 m.

The panel material may be larger in diameter than the hoop component by about 10% or more, about 20% or more, about 40% or more and any range between and include the percentages provided. The panel material may drape down from the hoop component when the hoop component is held horizontally and may have a drape depth of about 25 mm or more, about 50 mm or more, about 100 mm or more and any range between and including the drape depths provided. An exemplary panel material may Elastane fabric and may contain or be made out of Lycra fibers, available from DowDuPont, Wilmington DE.

An exemplary laundry retrieval device may have one or more handles or two or more handles, such as four handles. The handles may be formed by opening or apertures between the panel material and the hoop component. The apertures may be curved along the panel material and have a radius of curvature of about 50 mm or more, about 75 mm or more, about 100 mm or more and any range between and including the values provided. The opening or handle may have a size to enable a person's hand, or at least their fingers, to fit therethrough. A laundry retrieval device may have handles on opposing sides of the hoop component. A laundry retrieval device may have four handles each being configured substantially 90 degrees apart about the hoop component, or within about 15 degrees of 90 degrees.

The laundry retrieval device may enable a method of inserting and a method of retrieving laundry from a front-loaded laundry machine that utilizes gravity by rotation of the drum of the laundry machine. The laundry retrieval device may have laundry retained on the panel which may be inserted into the laundry machine through the door opening to the drum. The hoop component may be folded around the laundry to retain the laundry therein and/or to allow insertion through the door opening. The diameter of the laundry retrieval device may be greater than that of the door opening thereby requiring folding of the laundry retrieval device to enable insertion through the door opening. After the laundry retrieval device is configured in the laundry machine it may be released and the folded laundry retrieval device may pop open inside of the laundry machine. The person may then rotate the drum of the laundry machine until the laundry falls off the panel portion and down into the bottom of the drum due to gravity. The laundry retrieval device may be configured on the top or proximal to the top of the drum and the laundry may fall down to the bottom of the drum. The person may then retrieve the empty laundry retrieval device from the laundry machine. Again, the laundry machine may be a front-loaded washer or dryer.

The laundry retrieval device may be used to retrieve laundry from the laundry machine in a similar way. The door to the laundry machine may be opened after the cycle and the laundry retrieval device may be inserted through the door opening over the laundry configured in the bottom of the drum, or proximal to the bottom of the drum. The person may then rotate the drum to configure the laundry overtop of the laundry retrieval device such that gravity causes the laundry to fall down onto the laundry retrieval device, or panel thereof. The laundry retrieval device may then be retrieved from the laundry machine. Again, the laundry retrieval device may be folded or bent to allow insertion and subsequently be folded around the laundry configured on the panel to retain the laundry within the laundry retrieval device upon retrieval from the laundry machine.

The laundry retrieval device may have a diameter of about 40 cm or more, about 60 cm or more, about 80 cm or more and any range between and including the diameter values provided. The laundry retrieval device may be larger in diameter than the door opening to the laundry machine, thereby requiring the laundry retrieval device to be resilient and flexible as defined herein. A diameter may be a diameter of the hoop portion which may be a circular ring. A hoop portion may be other shapes however, such as rectangular having a pair of parallel sides and a pair of parallel ends. A rectangular hoop portion may have curved corners that extend along a radius of curvature, such as about 6 cm or more, about 8 cm or more, about 10 cm or more, about 12 cm or more, about 15 cm or more and any range between and including the radius of curvatures values provided, such as from about 6 cm to about 15 cm.

With reference to U.S. provisional patent application No. 63/316,728, the device described therein is equivalent to the laundry retrieval device described herein, the frame member is referred to as a hoop component or ring herein, the fabric or fabric panel is described herein a panel that may be a fabric, the cut-outs are referred to herein as apertures that form handles.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
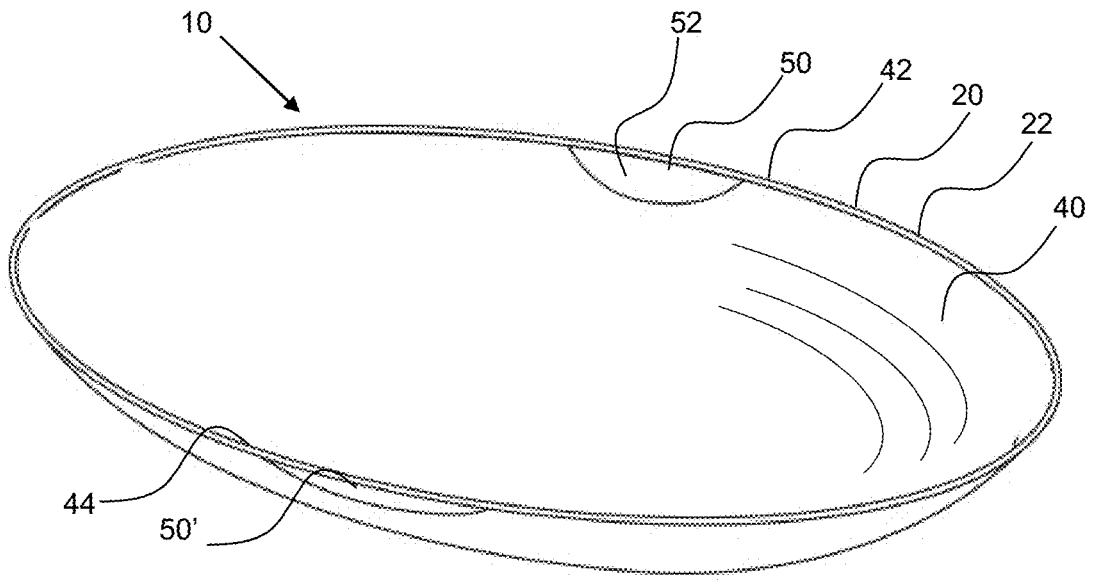
FIG. 1 shows a perspective view of an exemplary laundry retrieval device that has a panel extending within a hoop component and wherein the fabric drapes down within the hoop.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
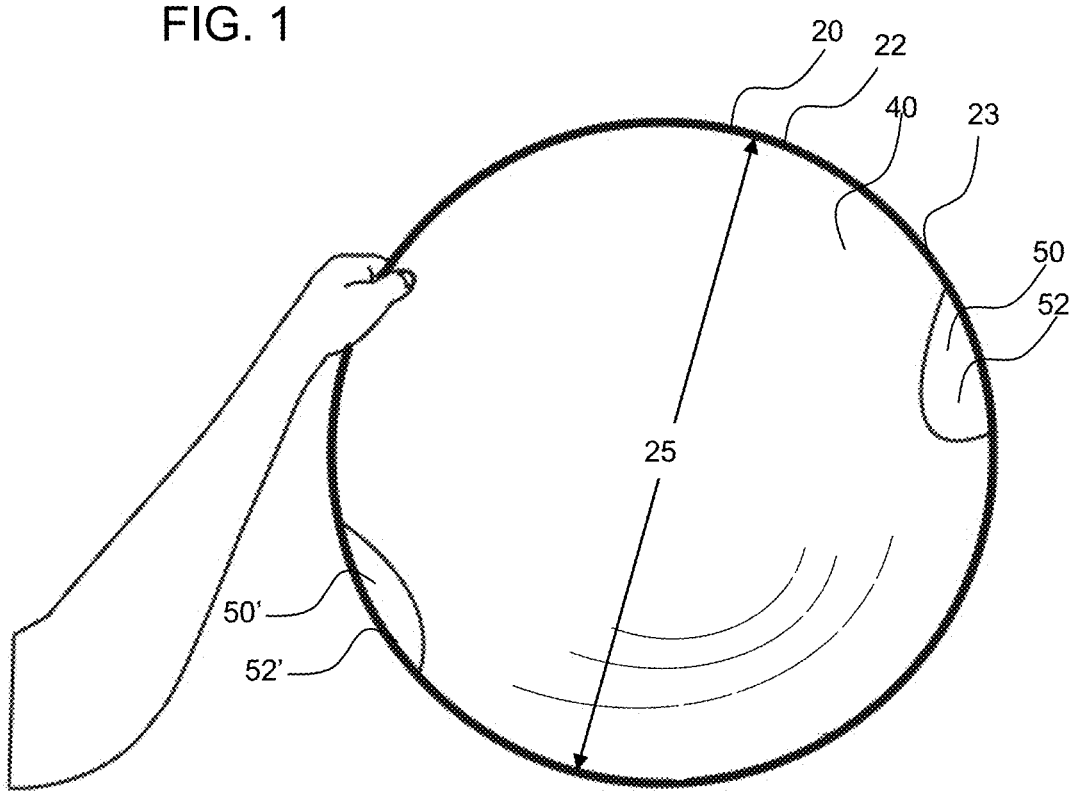
FIG. 2 shows a top view of an exemplary laundry retrieval device having four apertures between the hoop component and the panel forming four handles.

Referring to FIGS. 1 to 2, an exemplary laundry retrieval device 10 has a panel 40 extending within a hoop component 20, wherein the panel drapes down within the hoop. The hoop component comprises a ring 22 that has an outer perimeter 23 forming a circle having a diameter 25. There are four apertures 50, 50', 50", 50''' that form handles 52, 52', 52" and 52''' between the panel 40 and the ring 22 or hoop component 20. The handles may be configured across the hoop component from each other, or as shown about 90 degrees offset from each outer about the perimeter 23. The laundry retrieval device is resilient and flexible such that it can be folded to place a first side 42 next to an opposing second side 44 and then rebound back to a circular shape upon release of the folded configuration. The first side may be about 180 degrees from the second side.

Figure 3:
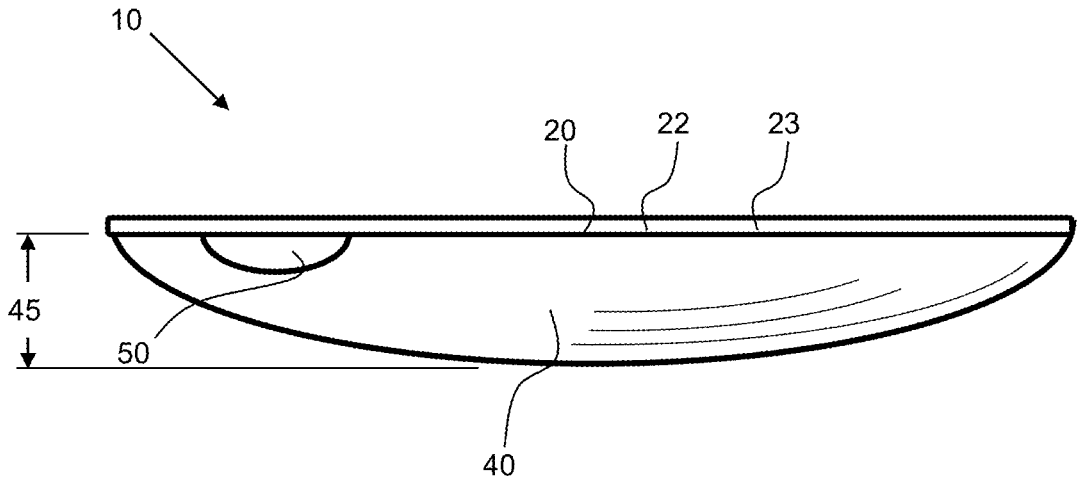
FIG. 3 shows a side view of an exemplary laundry retrieval device with the hoop component horizontal and the panel material draping down a drape depth from the hoop component.
Figure 4:
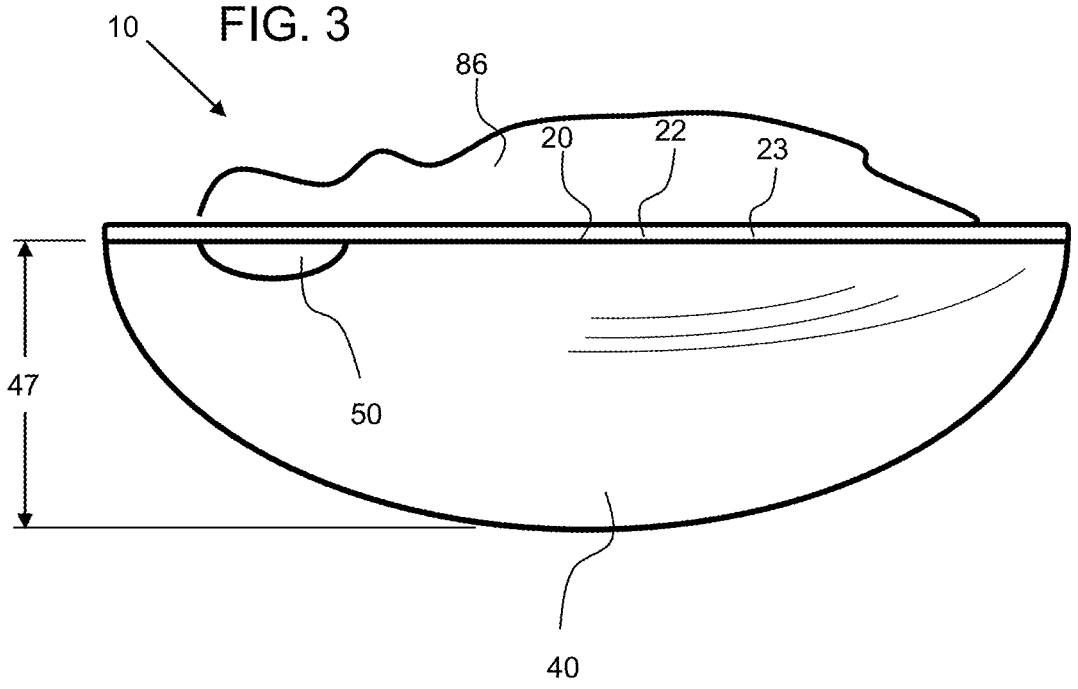
FIG. 4 shows a side view of the laundry retrieval device shown in FIG. 3 with laundry therein and the panel material elongated to form a retaining bowl shape for the laundry therein.

Referring now to FIGS. 3 and 4, the laundry retrieval device 10 has a panel 40 material that is elastic and can elongate to accommodate laundry therein. As shown in FIG. 3, the panel 40 has a drape when the hoop component 20 is held horizontally without any laundry within the panel, or when empty. The drape depth 45 of the panel 40 may be about 25 mm or more, about 50 mm or more, about 100 mm or more and any range between and in including the drape depths provided. The drape depth is the depth of the panel from the hoop component when the hoop is held horizontally and when there is nothing within the panel. As shown in FIG. 4, the laundry retrieval device 10 has laundry therein and the panel 40 material is elongated to form a retaining bowl shape for the laundry 86 therein having an elongated dept 47 that is greater than the drape depth. The panel material may be an elastic material or fabric as described herein to allow expansion and stretching of the panel and this elongated depth.

Figure 5:
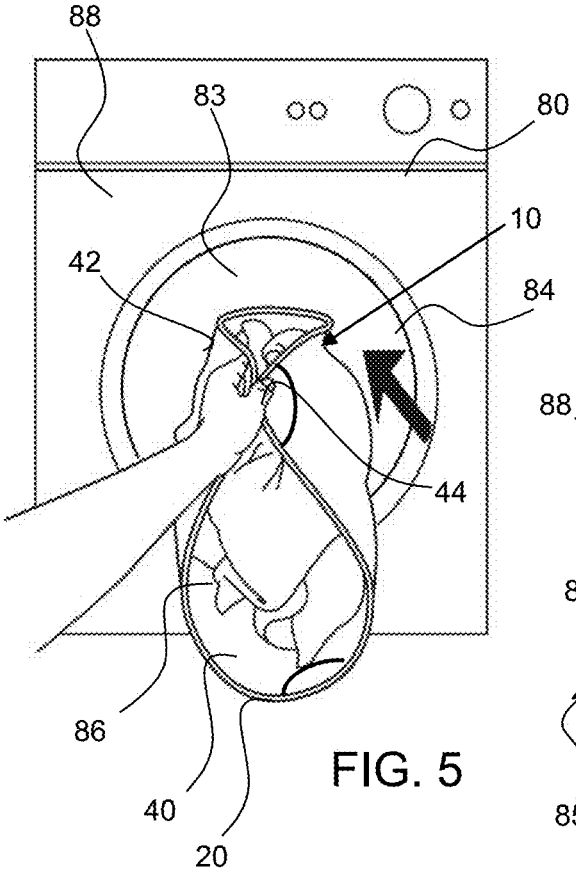
FIG. 5 shows an exemplary laundry retrieval device being used to insert laundry into a laundry machine with a first side of the laundry retrieval device folded over toward a second side of the laundry retrieval device to retain the laundry therein.
Figure 6:
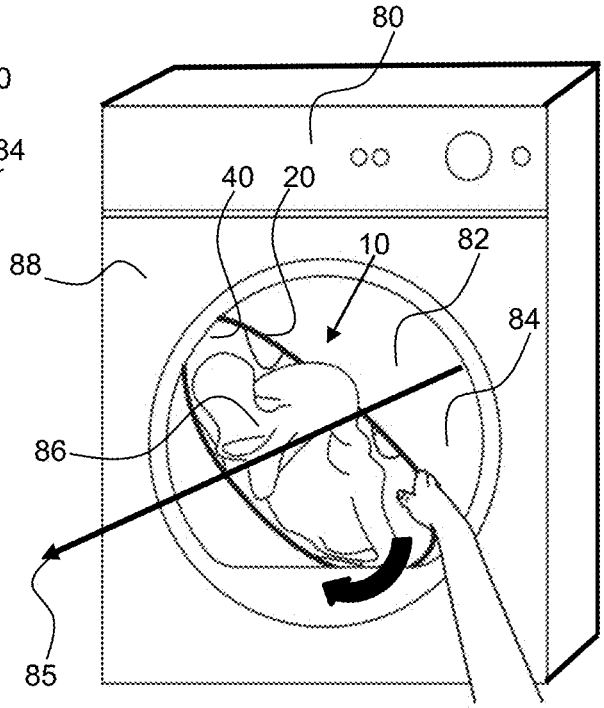
FIG. 6 shows an exemplary laundry retrieval device configured inside of the laundry machine and the user rotating the drum of the laundry machine to dispense the laundry off of the laundry retrieval device and onto the drum of the laundry device.
Figure 7:
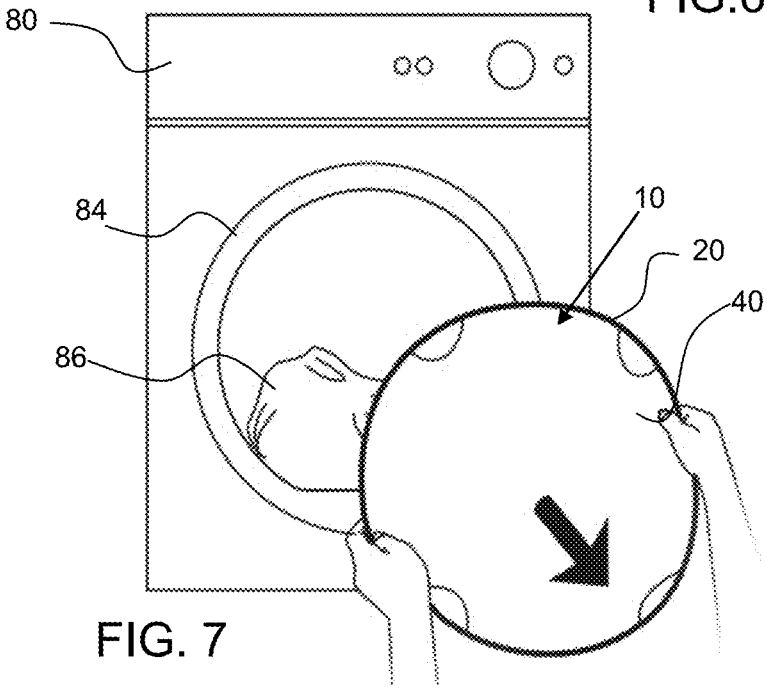
FIG. 7 shows an exemplary laundry retrieval device being removed from the laundry machine after insertion and rotation of the drum to insert the laundry onto the drum of the laundry machine.
Figure 8:
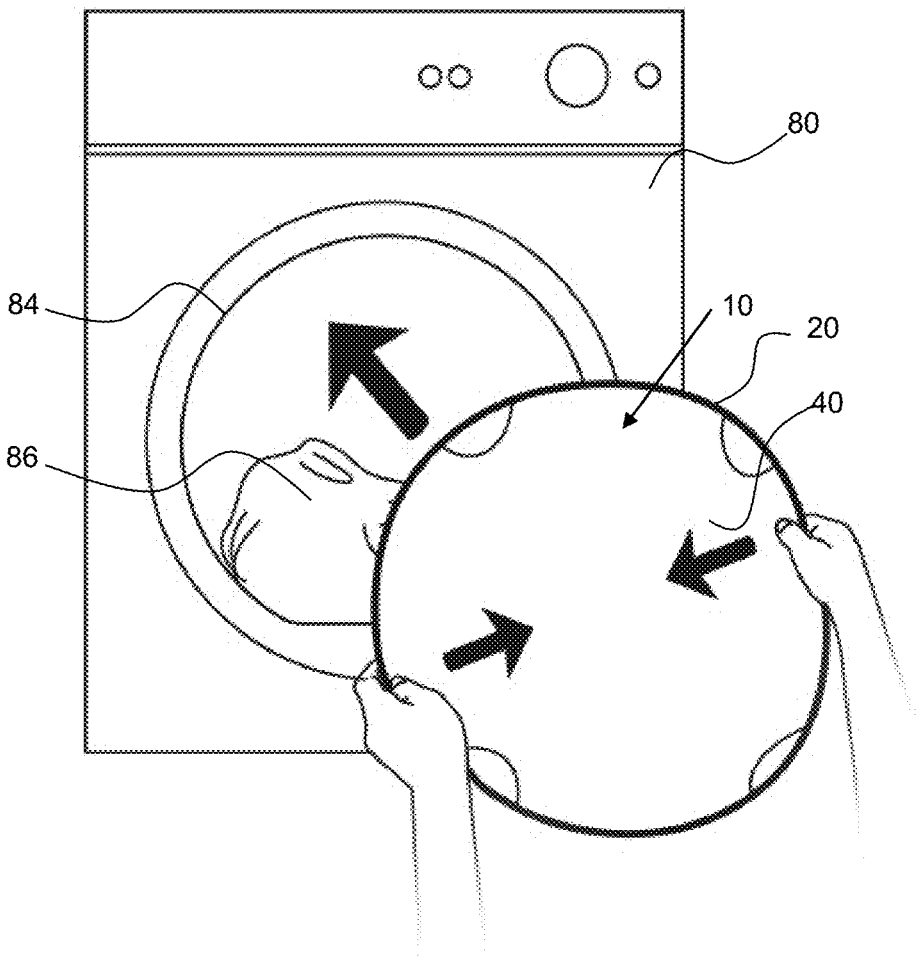
FIG. 8 shows an exemplary laundry retrieval device being inserted into a laundry machine for retrieval of the laundry from the laundry machine.
Figure 9:
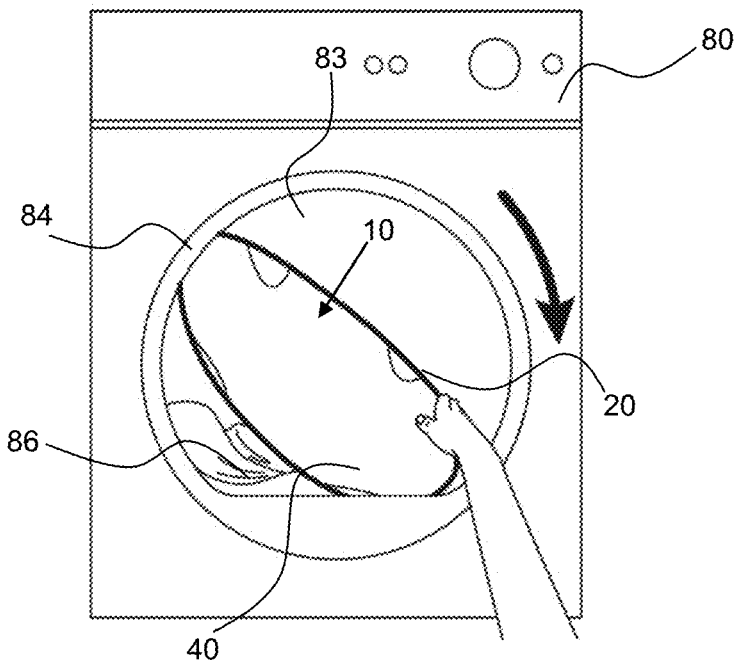
FIG. 9 shows an exemplary laundry retrieval device configured in the laundry machine and the drum of the laundry machine being rotated to configure the laundry over the laundry retrieval device, wherein the laundry falls onto or into the laundry retrieval device for retrieval.

Referring now to FIGS. 5 to 7, an exemplary laundry retrieval device 10 is being used to insert laundry 86 into a laundry machine 80 with a first side 42 of the laundry retrieval device folded over toward a second side 44 of the laundry retrieval device to retain the laundry therein, or in a folded configuration. The folded laundry retrieval device 10 is inserted into the front-loaded laundry machine 80 through the door opening 83 on the front side 88 of the laundry machine 80. After the laundry retrieval device is inserted into the laundry machine 80 through the door opening 83, the folded laundry retrieval device may be release from the folded configuration. As shown in FIG. 6, the drum 84 of the laundry machine 80 is being spun or rotated about the rotational axis 85 of the drum, which extends horizontally, to dispense or insert the laundry 86 onto the drum 84. As shown in FIG. 7, the laundry retrieval device 10 is being pulled back out of the laundry machine 80 to leave the laundry 86 in the laundry machine 80.

Figure 10:
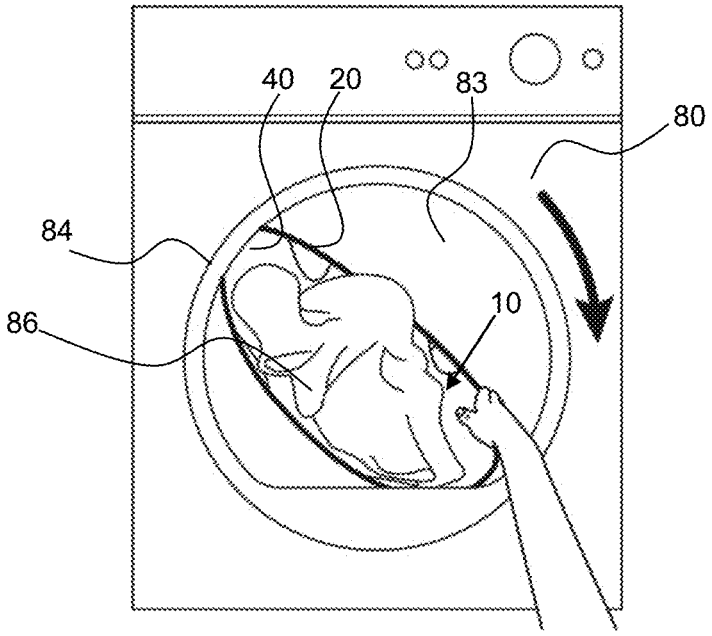
FIG. 10 shows an exemplary laundry retrieval device in a laundry machine with the laundry now on the panel of the laundry retrieval device after rotation of the drum of the laundry machine.
Figure 11:
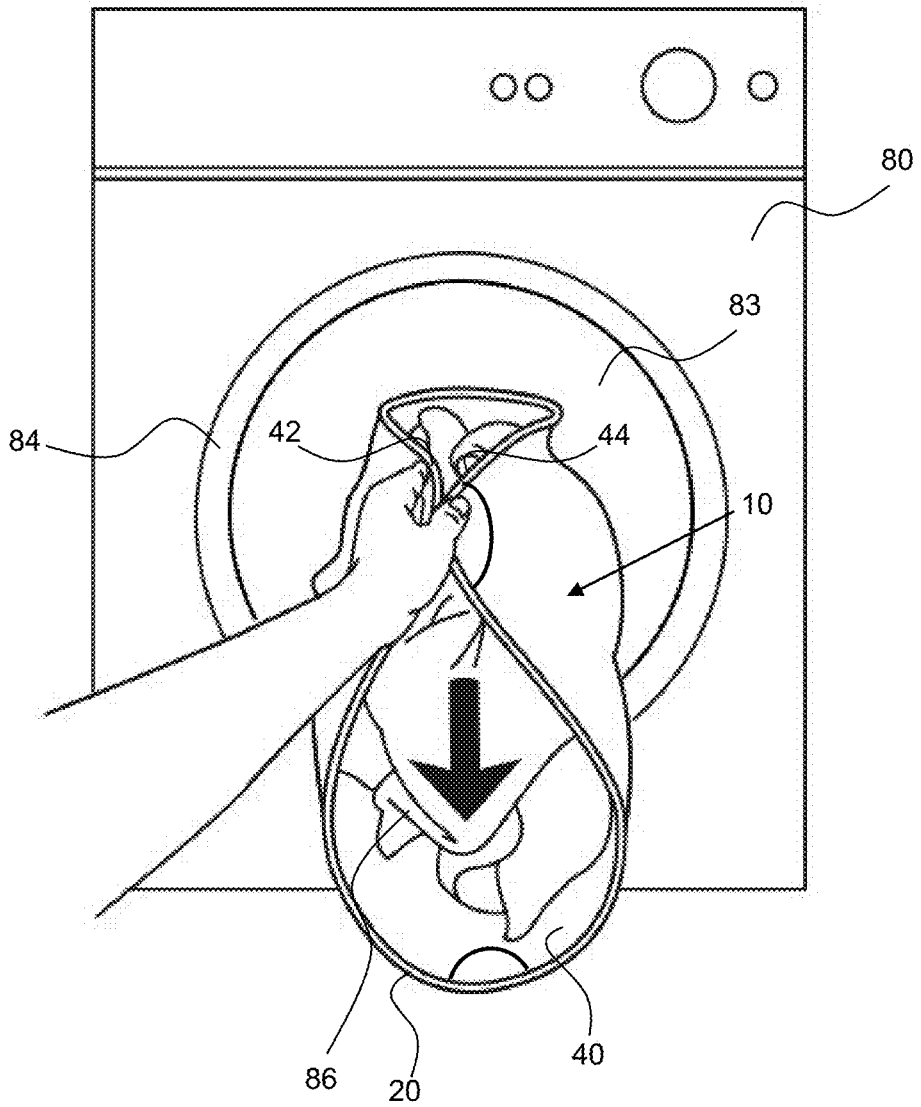
FIG. 11 shows an exemplary laundry retrieval device being used to retrieve the laundry from the laundry machine with a first side of the laundry retrieval device folded over toward a second and opposing side of the laundry retrieval device.

Referring now to FIGS. 8 to 11, an exemplary laundry retrieval device 10 is configured for retrieval of the laundry 86 from the laundry machine 80. The laundry retrieval device 10 is flexible such that it can be folded, or bent and then inserted into a laundry machine and place over the laundry 86 in the laundry machine 80, as indicated by the bold arrows in FIG. 8. The flexible and resilient nature of the laundry retrieval device 10 may allow the laundry retrieval device 10 to maintain a position within the drum 84 of the laundry machine 80. The drum 84 of the laundry machine 80 may then be rotated, as indicated by the curved arrow about the perimeter of the drum in FIG. 9, to configure the laundry 86 over the laundry retrieval device 10 such that the laundry falls or rolls onto the panel 40 of the laundry retrieval device 10, as shown in FIG. 10. The laundry retrieval device 10 may maintain a position within the drum with the hoop component 20 pressed against the interior sides of the drum. As shown in FIG. 11, the laundry retrieval device 10 may then be folded about the laundry 86 with the first side 42 configured proximal to the second side 44 for retrieval of the laundry 86 from the laundry machine 80. Folding of the laundry retrieval device 10 may allow the laundry retrieval device 10 to fit through the door opening 83. The diameter of the laundry retrieval device 10 may be greater than the diameter of the door opening, thereby requiring deformation, bending or folding of the laundry retrieval device 10 to allow insertion and retrieval from laundry machine 80.

Figure 12:
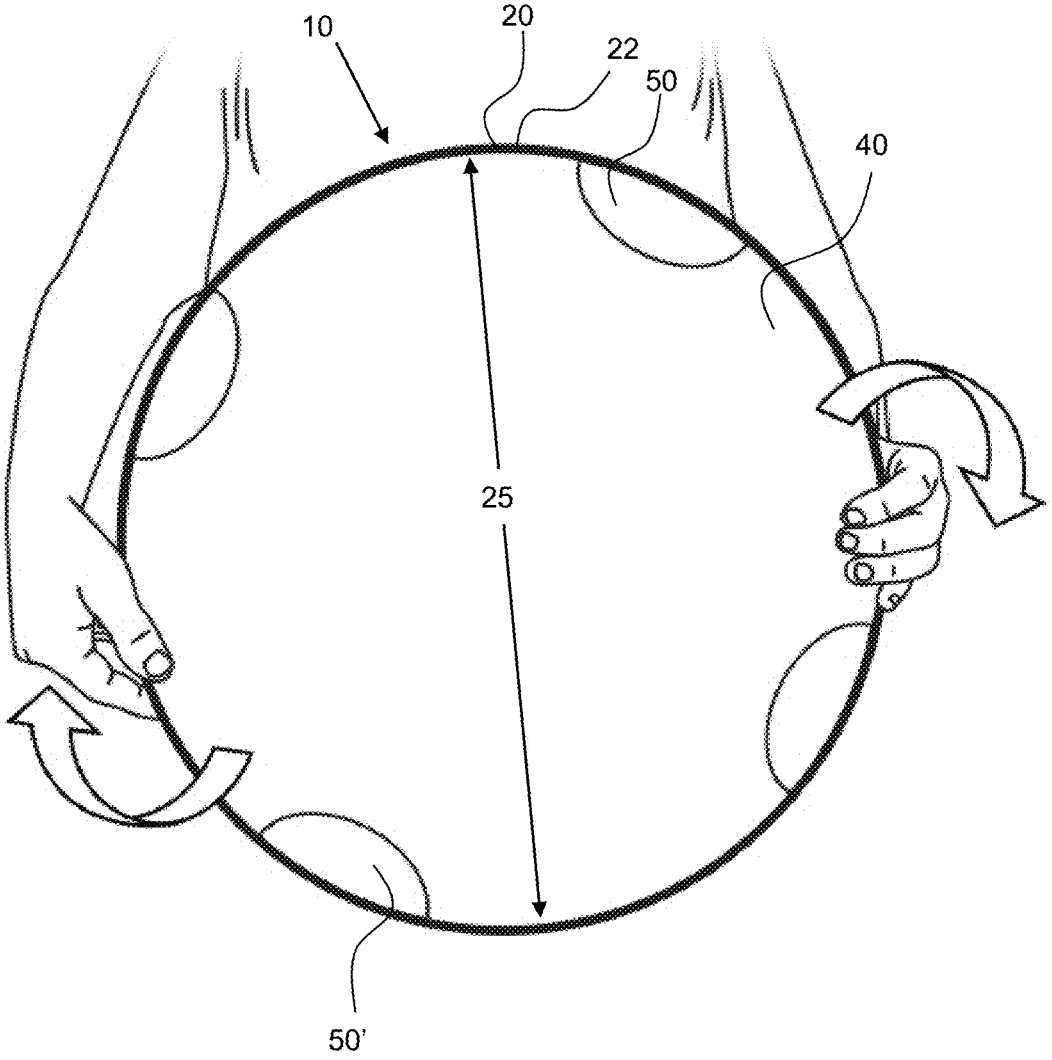
FIG. 12 shows an exemplary laundry retrieval device being twisted to form a collapsed laundry retrieval device.
Figure 13:
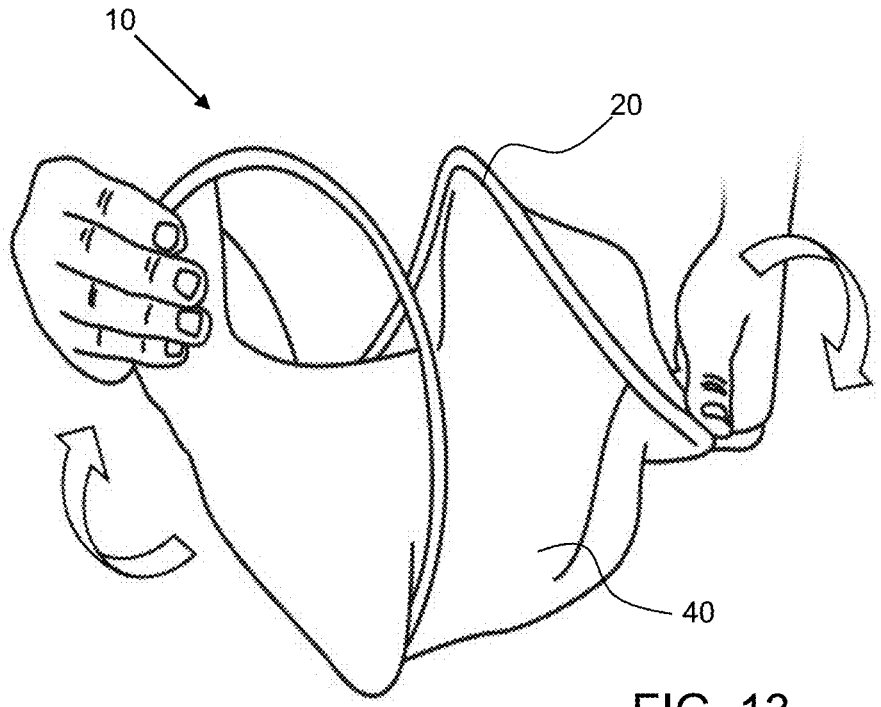
FIG. 13 shows a perspective view of an exemplary laundry retrieval device being twisted to form a collapsed laundry retrieval device having two spiral hoops.
Figure 14:
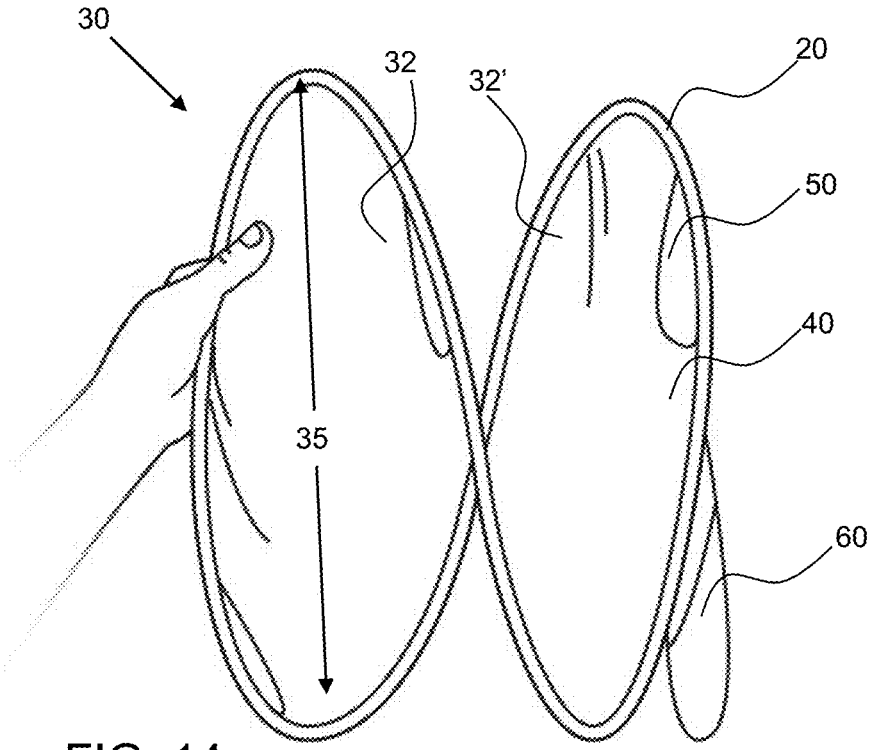
FIG. 14 shows a perspective view of an exemplary collapsed laundry retrieval device having two spiral hoops.

Referring now to FIGS. 12 to 14, an exemplary laundry retrieval device 10 is configured to be twisted to form a collapsed laundry retrieval device 30, as shown in FIG. 14 having spiral hoops 32, 32'. The diameter 35 of the spiral hoop 32 may by less than the diameter 25 of the laundry retrieval device 10, as shown in FIG. 12. As shown in FIG. 13, the laundry retrieval device 10 is twisted to form the spiral hoops and the collapsed laundry retrieval device 30 shown in FIG. 14.

Figure 15:
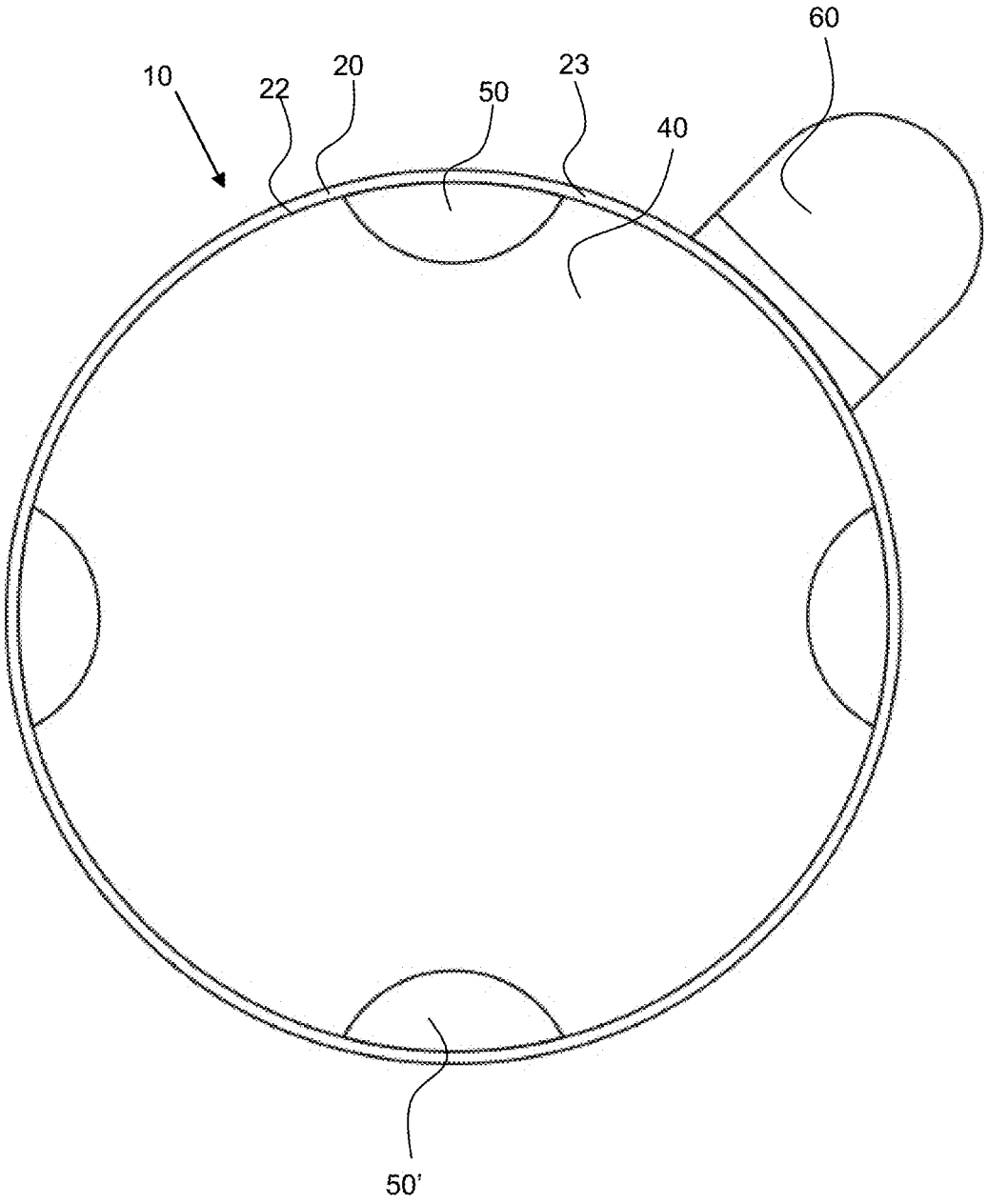
FIG. 15 shows a top view of an exemplary laundry retrieval device having four handles configured approximately 90 degrees about the perimeter of the hoop component and a pouch for retaining a collapsed laundry retrieval device therein.
Figure 16:
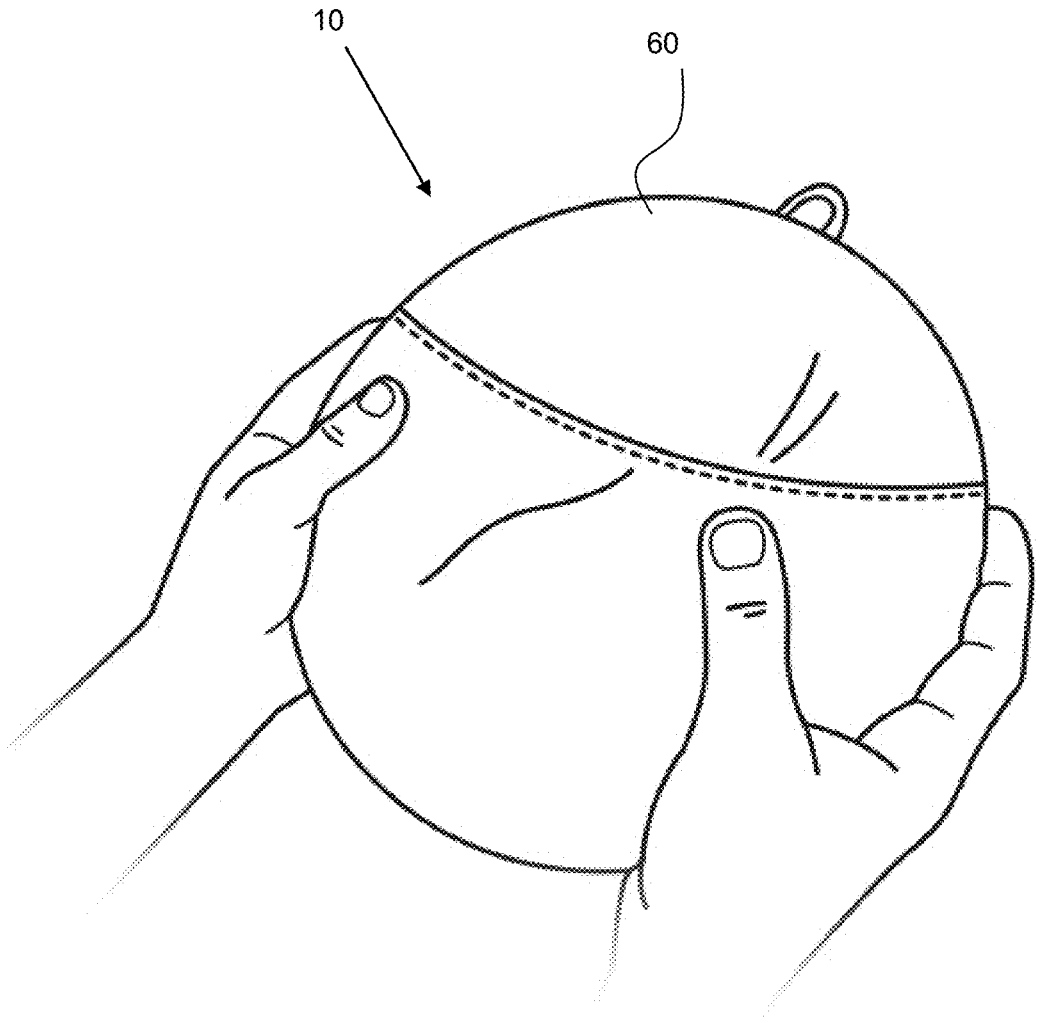
FIG. 16 shows an exemplary collapsed laundry retrieval device configured in the pouch
Figure 17:
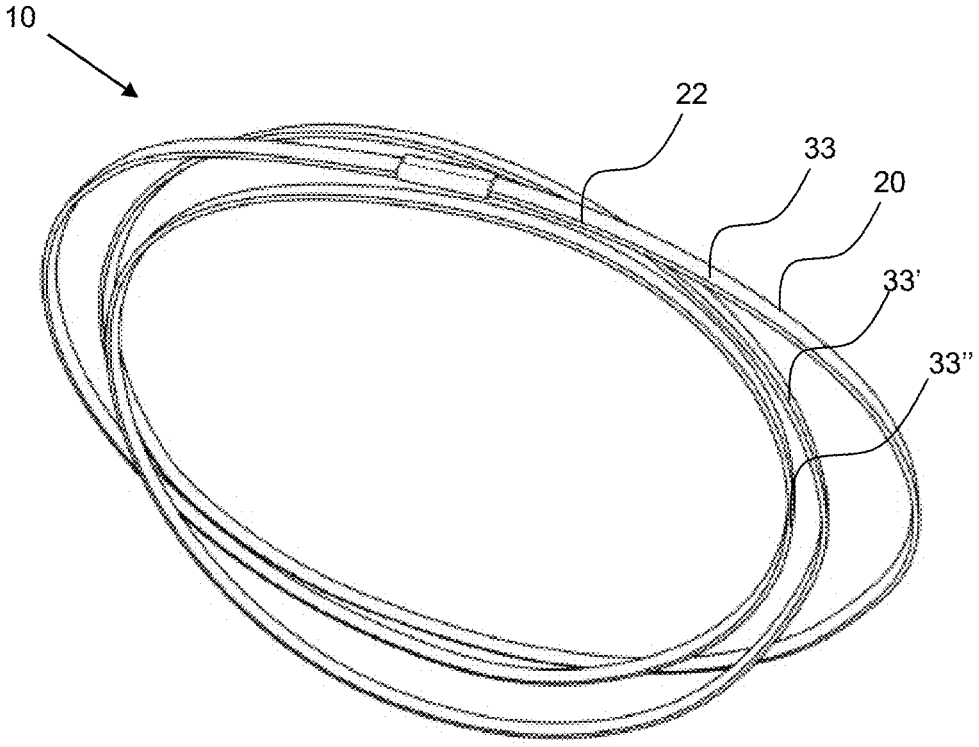
FIG. 17 shows a perspective view of an exemplary hoop component of a laundry retrieval device collapsed to form three spiral rings.

Referring now to FIGS. 15 to 17, an exemplary laundry retrieval device 10 has a pouch 60 extending from the outer perimeter 23 of the hoop component 20 to retain the collapsed laundry retrieval device therein, as shown in FIG. 16. The hoop component may be collapsed and then packed into the pouch 60. The pouch is configured on the laundry retrieval device 10 shown in FIGS. 1 to 13 but is not visible from the perspective shown, as it is folded down along a back side of the panel.

As shown in FIG. 17, an exemplary hoop component 20 of a laundry retrieval device 10 is collapsed to form three spiral rings 33, 33', 33". A collapsed laundry retrieval device 30, as shown in FIG. 13 may have two spiral hoops to enable configuring the collapsed laundry retrieval device 30 into the pouch 60.

Figure 18:
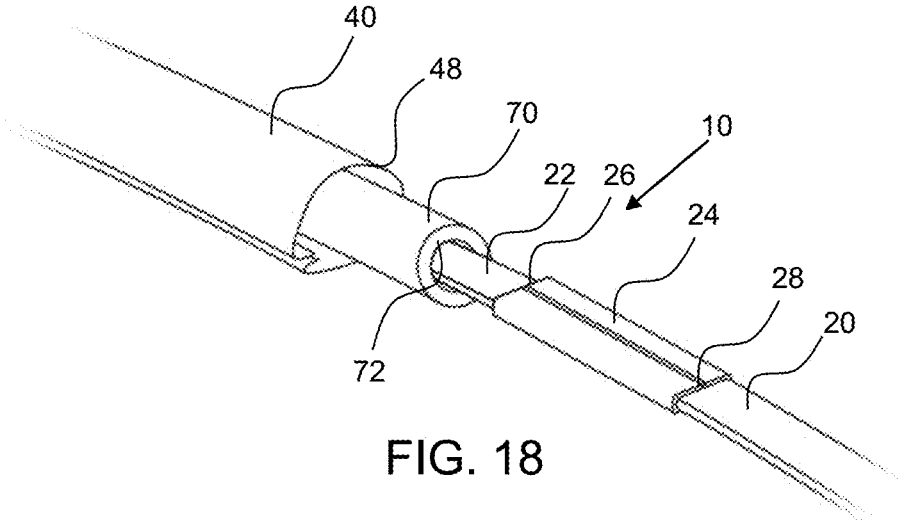
FIG. 18 shows a perspective cut away view of a portion of the laundry retrieval device and the hoop component having a hoop cover that both extend into a panel sleeve.

As shown in FIG. 18, the hoop component 20 has a rectangular shape or is rectangular in cross-section and has a coupling 24 to join a first end 26 and a second end 28 of the ring 22 of the hoop component together to form said hoop. Also, a hoop cover 70 extends over the hoop component or ring 22 and is a cover sleeve 72 for receiving the hoop component therein. As described herein, the cover may provide a more comfortable handle for a user to handle the hoop component. The hoop component may have square corners that are uncomfortable to handle and manipulate when collapsing the laundry retrieval device 10. The ring 22 and the hoop cover 70 extend through the panel sleeve 48 formed by the panel 40 and extending around the outer perimeter of the laundry retrieval device 10. The panel sleeve may extend substantially around the entire ring or hoop component such as at least 340 degrees, and preferably at least 350 degrees of the 360 degree perimeter of the ring or hoop component.

Figure 19:
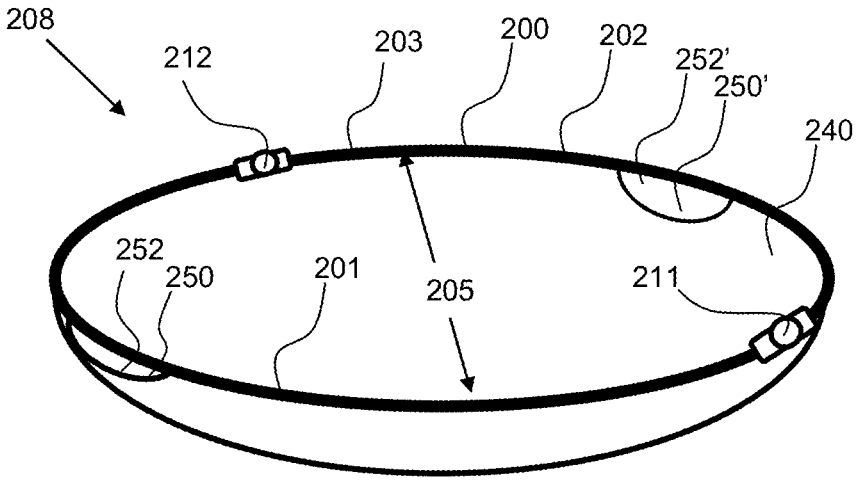
FIG. 19 shows a perspective view of a laundry retrieval device having a hinged flexible hoop component configured around a top and a panel extending within the flexible hoop to receive laundry therein.
Figure 20:
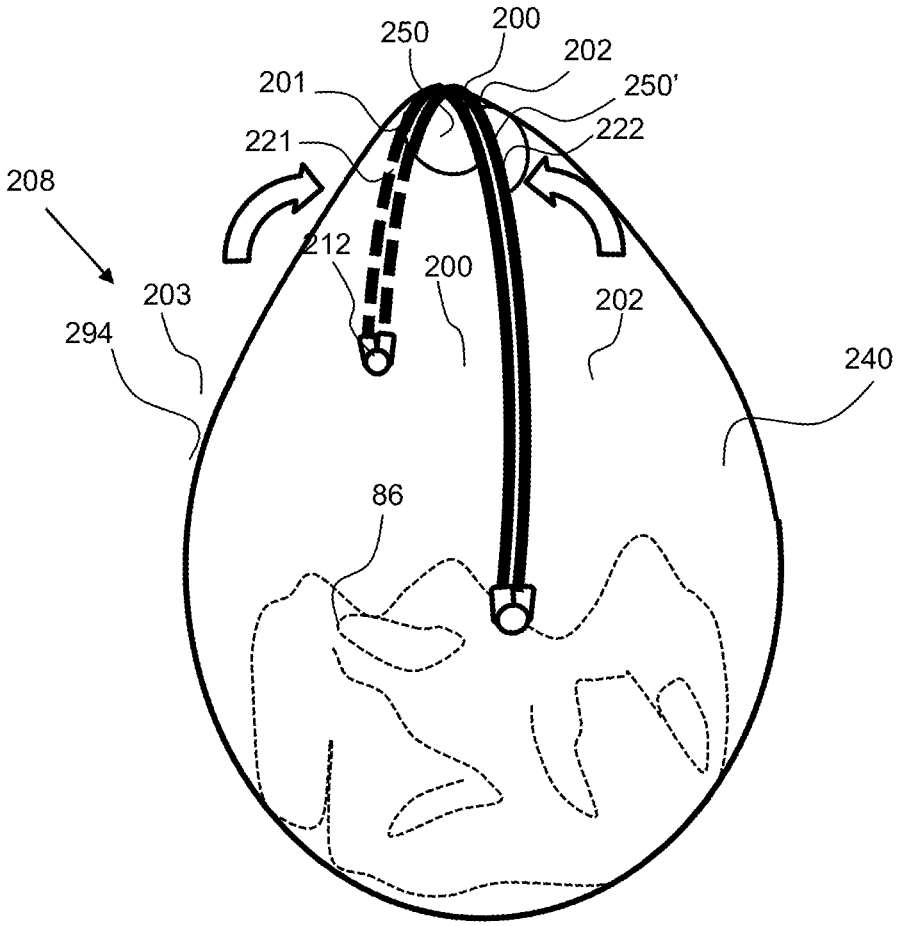
FIG. 20 shows a perspective view of the laundry retrieval device shown in FIG. 19, now with the hoop component pivoted about the hinge to bring a first extension of the hoop component toward the second extension of the hoop component.
Figure 21:
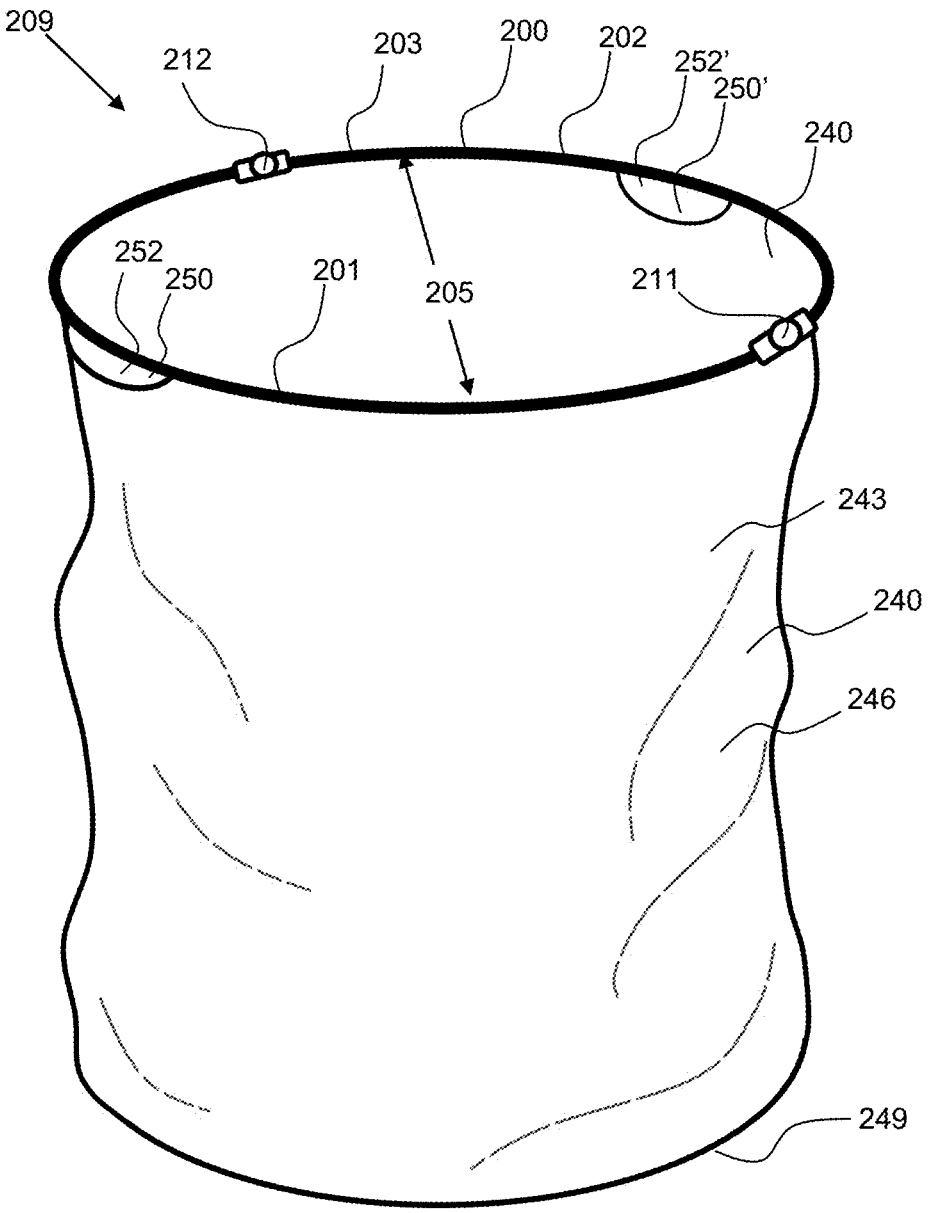
FIG. 21 shows a perspective view of a laundry retrieval device having a flexible hoop component configured around a top opening and a cylindrical panel extending from the hoop component.

Referring now to FIGS. 19 to 20, an exemplary laundry retrieval device 208 has a hoop component 200 and a panel 240 that extends within the hoop component. The panel form may be an elastic fabric that has drape, as described herein. The hoop component 200 has a first extension 201 and a second extension 202 that are configured to pivot about the first hinge 211 and second hinge 212. The hinges may be configured opposite each other to form to equal sized first hoop handle 221 and second hoop handle 222 as shown in FIG. 21. The hoop handle 220 may be used to transport laundry in the panel sack 243 from a retainer to a laundry machine and back. The hoop component 200 is circular and has a diameter 205. Also, additional handles 252, 252' are formed by apertures 250, 250' between the panel 240 and the hoop component 200. Laundry 86, such as clothes, are configured in the closed laundry retrieval device 208 as shown in FIG. 20. The pivoting of the first extension 201 and a second extension 202 of the hoop component 200 forms an enclosure 206 for retaining laundry therein.

Referring now to FIGS. 21 to 27, an exemplary laundry retrieval device 209 has a hoop component 200 and a panel 240, a panel sack 243 that extends down from the hoop component to form a panel receptacle 246. The panel form a cylindrical extension 245 from the hoop component that extends down to the base 249 of the panel sack. The hoop component 200 has a first extension 201 and a second extension 202 that are configured to pivot about the first hinge 211 and second hinge 212. The hinges may be configured opposite each other to form to equal sized first hoop handle 221 and second hoop handle 222 as shown in FIG. 21. The hoop handle 220 may be used to transport laundry in the panel sack 243 from a retainer to a laundry machine and back.

Figure 22:
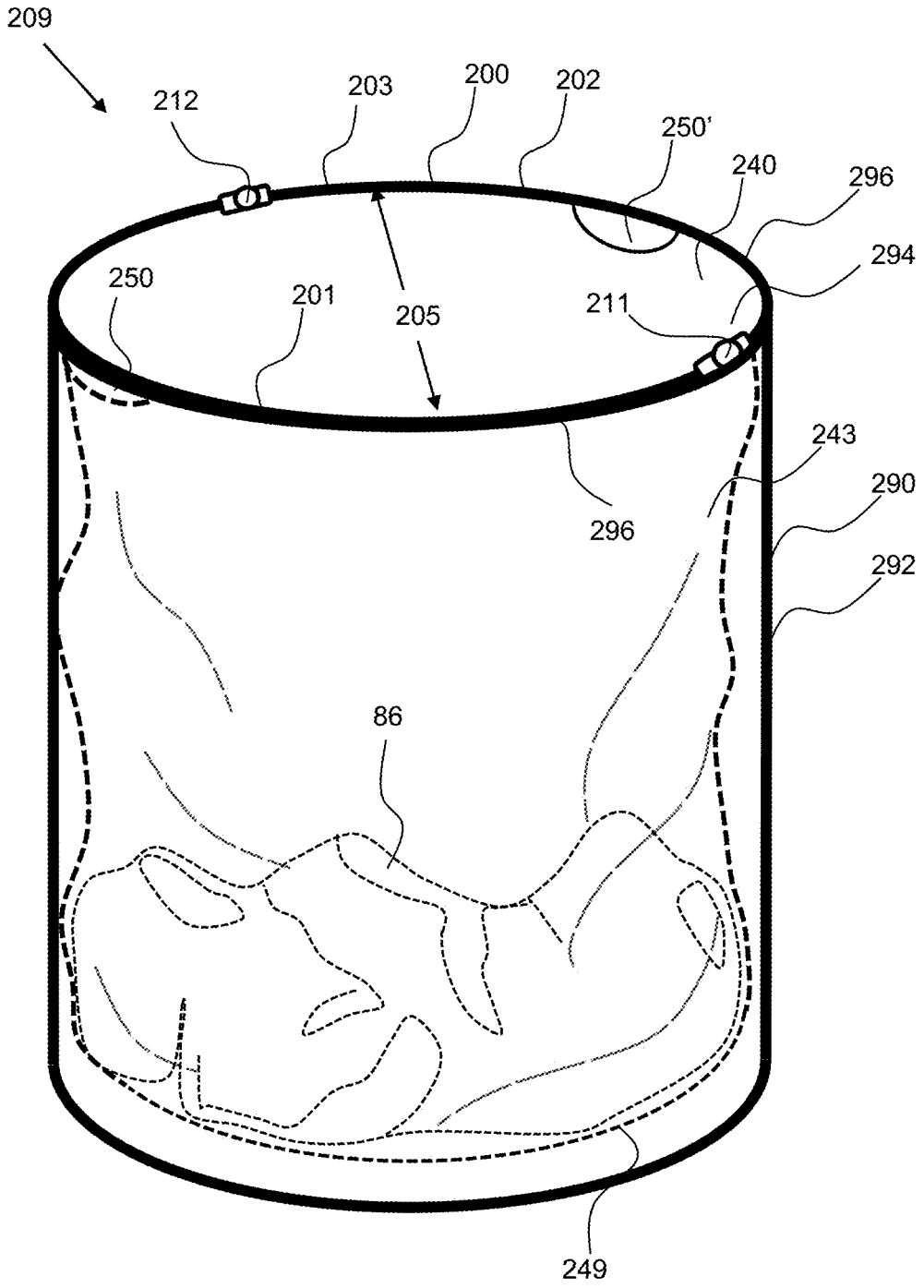
FIG. 22 shows a perspective view of the laundry retrieval device shown in FIG. 21, now configured in a receptacle that retains the hoop component along a top rim of the retainer.

As shown in FIG. 22, the hoop component 200 is circular and has a diameter 205. Also, additional handles 252, 252' are formed by apertures 250, 250' between the panel 240 and the hoop component 200. The laundry retrieval device 209 is retained in a retainer 290 that is a cylindrical retainer 292 having a retainer opening 294 in the top that forms a retainer rim 296 that is configured to receive the hoop component and retain it thereon. The outer perimeter 203 of the hoop component may be larger in diameter 205 than the retainer rim 296 of the retainer 290 to support the hoop thereon. Laundry 86, such as clothes, are configured in the panel sack 243.

Figure 23:
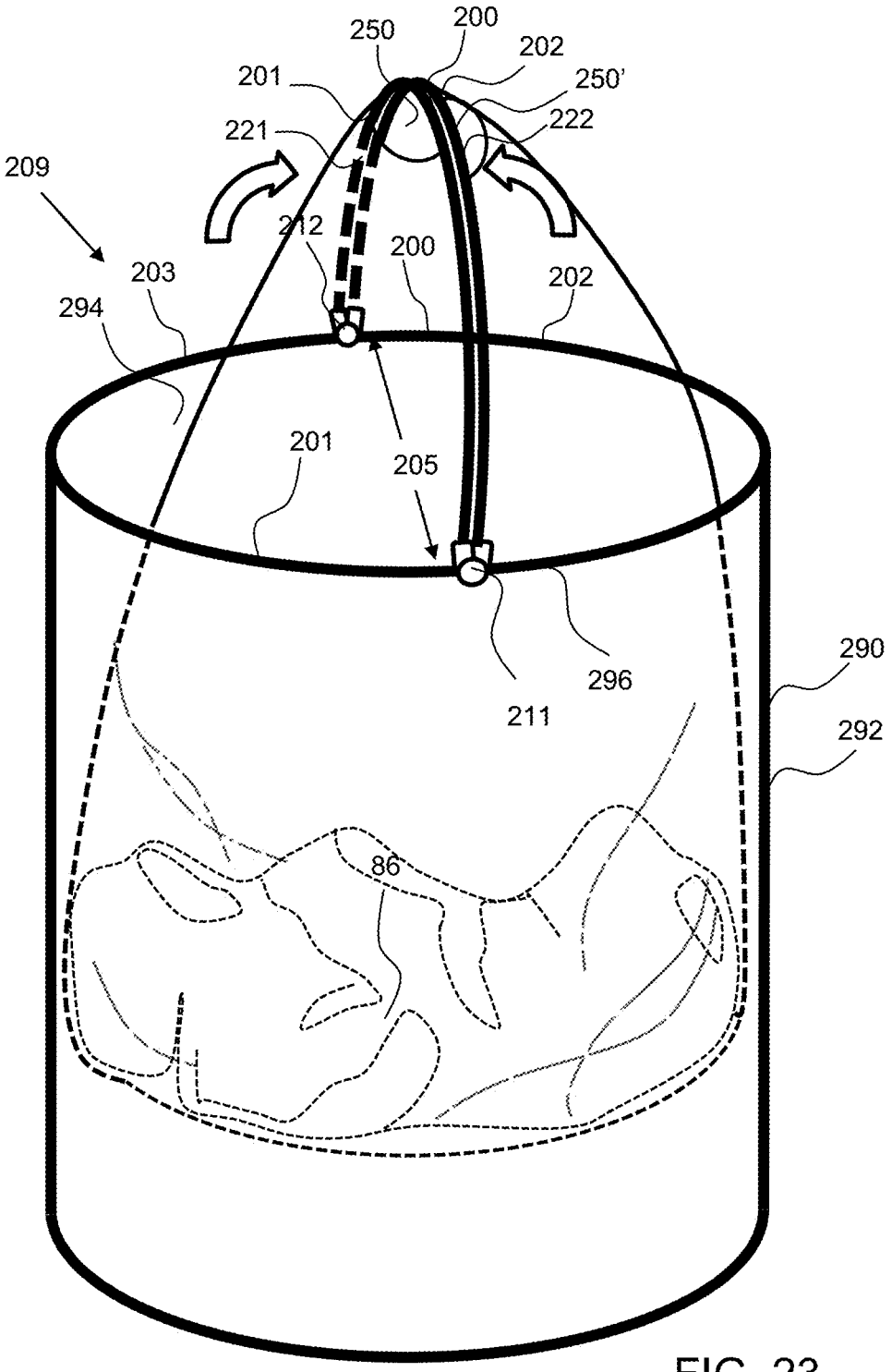
FIG. 23 shows a perspective view of a laundry retrieval device shown in FIG. 22, having a flexible hoop component configured around a top opening and a cylindrical panel extending from the hoop component, wherein the hoop component is configured to pivot about hinges.

As shown in FIG. 23, the first extension 201 and second extension 202 of the hoop component 200 are rotated up about the first hinge 211 and second hinge 212 to form a first hoop handle 221 and second hoop handle 222.

Figure 24:
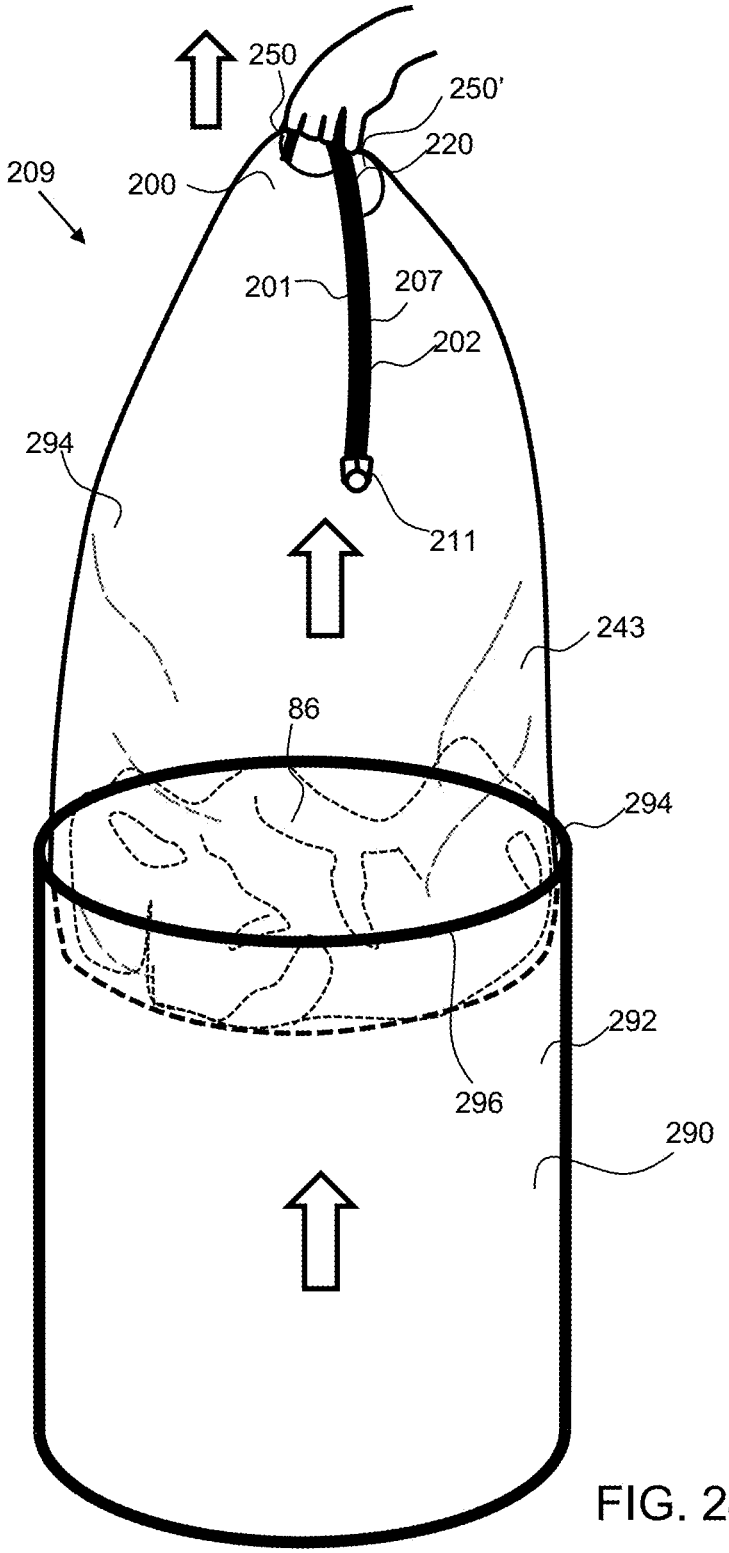
FIG. 24 shows a perspective view of the laundry retrieval device shown in FIG. 23, being removed from the retainer.

As shown in FIG. 24, the laundry retrieval device 209 is being lifted by hand out of the retainer 290. A person is using their hand to grasp the hoop handle 220 to lift the panel sack 243 out of the retainer 290 through the retainer opening 294. The hoop component comprises a ring 207 that has an outer perimeter forming a circle having a diameter 205. The two apertures 250, 250' form handles 252, 252', between the panel 240 and the ring 207 or hoop component 200. The handles may be configured across the hoop component from each other, or as shown about 180 degrees offset from each outer about the perimeter 23.

Figure 25:
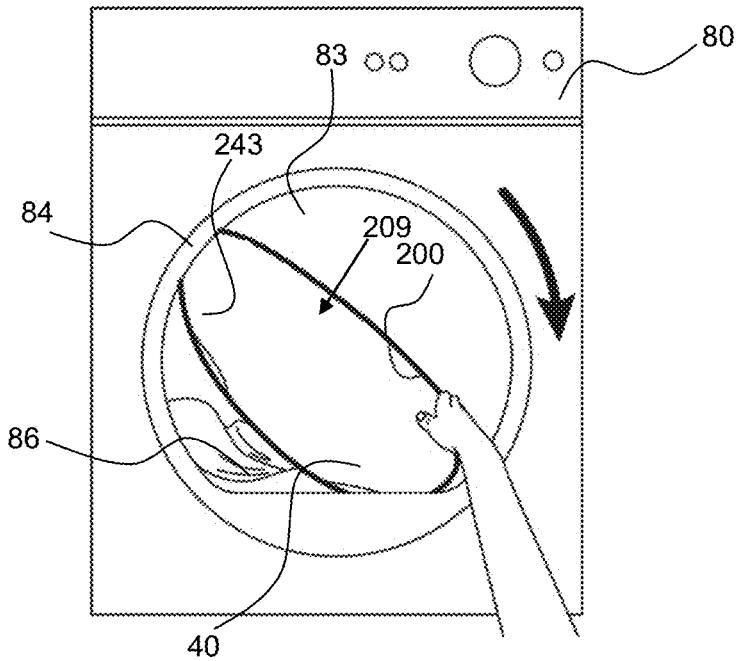
FIG. 25 shows the exemplary laundry retrieval device as shown in FIG. 24 configured in the laundry machine and the drum of the laundry machine being rotated to configure the laundry over the laundry retrieval device, wherein the laundry falls onto or into the laundry retrieval device for retrieval.
Figure 26:
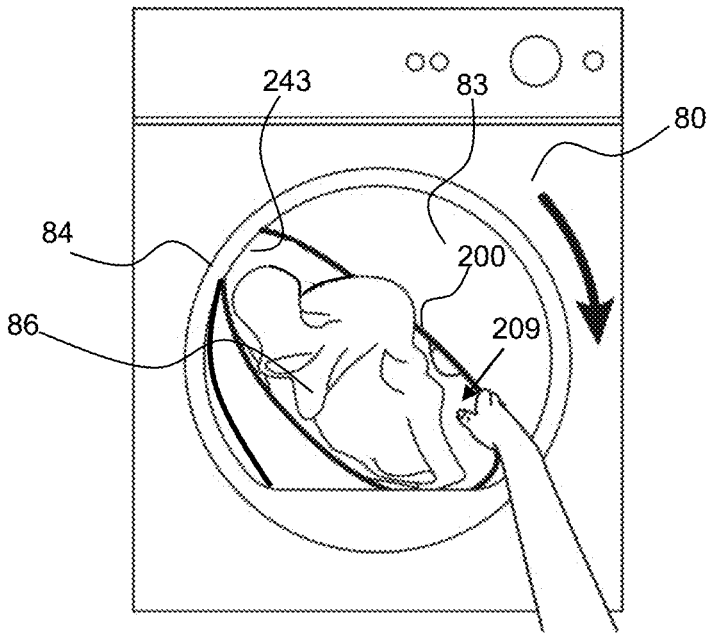
FIG. 26 shows the exemplary laundry retrieval device as shown in FIG. 24 in a laundry machine with the laundry now on the panel of the laundry retrieval device after rotation of the drum of the laundry machine.
Figure 27:
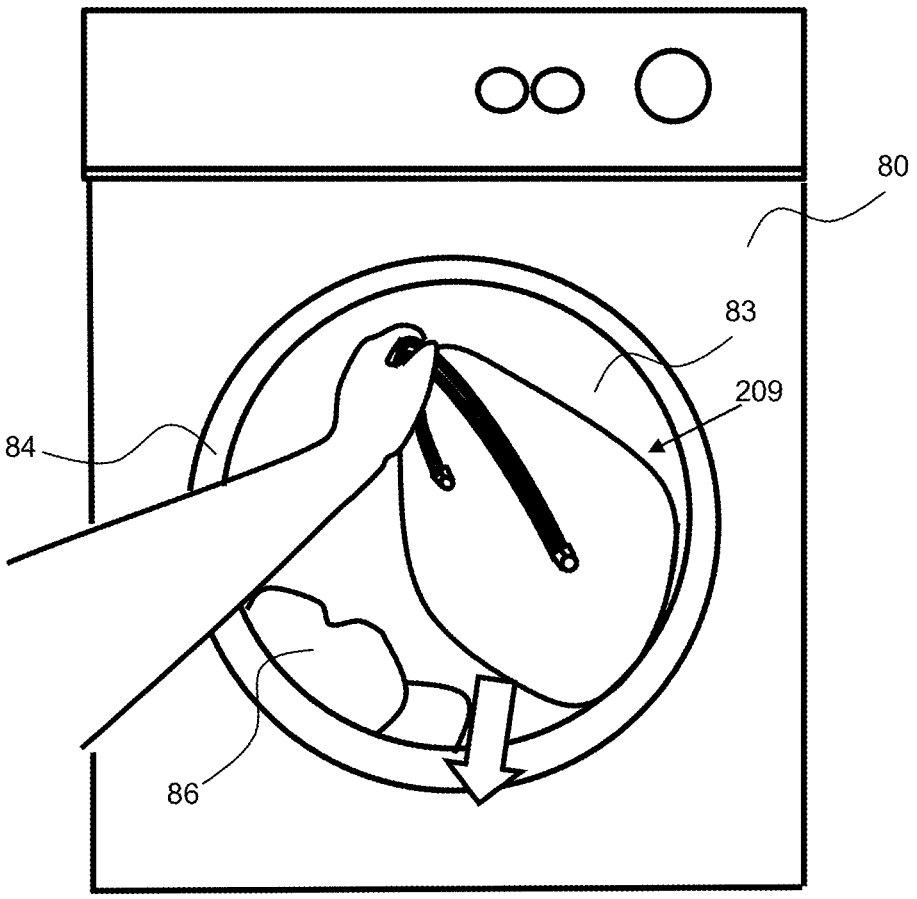
FIG. 27 shows the exemplary laundry retrieval device as shown in FIG. 24 being retracted from the laundry machine after rotation of the drum of the laundry machine.
Figure 28:
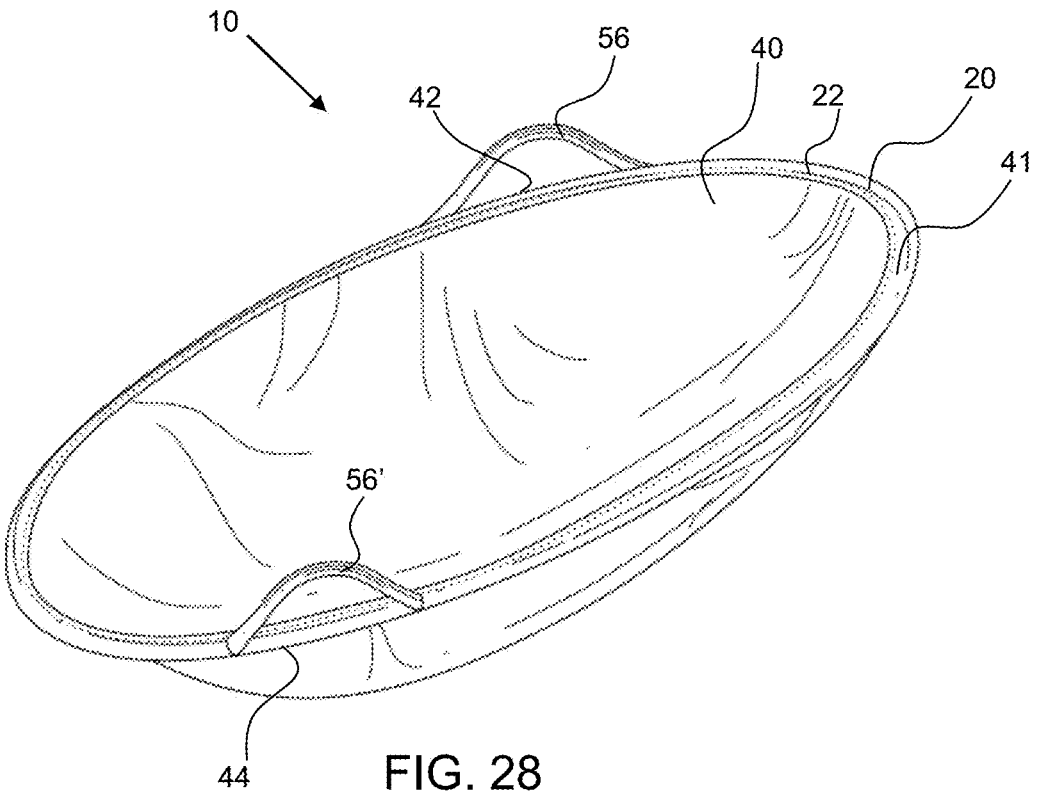
FIG. 28 shows a top side perspective view of an exemplary laundry retrieval device that has a panel extending within a hoop component and having two handles extending from the hoop component and wherein the panel fabric drapes down within the hoop.
Figure 29:
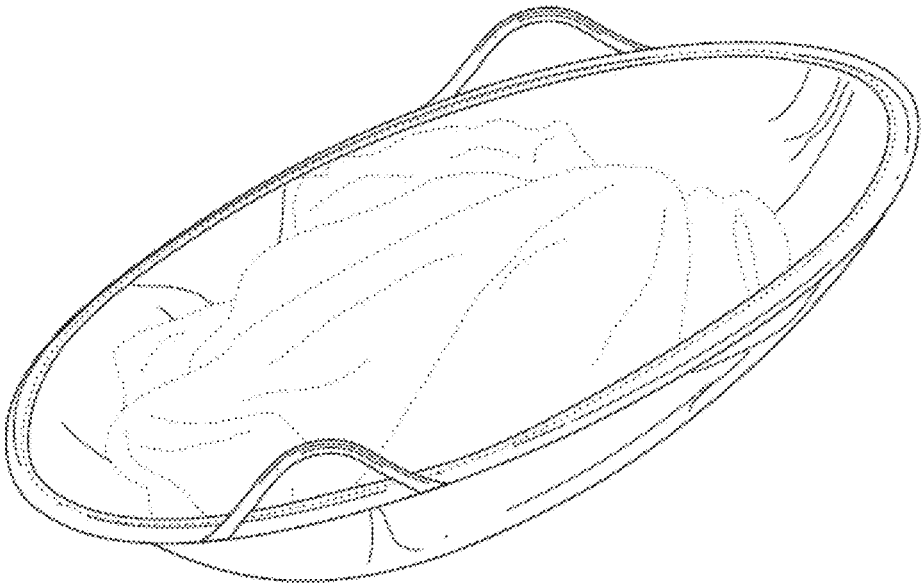
FIG. 29 shows the exemplary laundry retrieval device shown in FIG. 28 with clothes retained on the panel.

As shown in FIG. 25, the laundry retrieval device 209 has been inserted into a laundry machine 80 through the door opening 83. The drum 84 of the laundry machine is being rotated to dump the laundry 86 out of the panel sack 243. As shown in FIG. 24 the drum is further rotated to dump the laundry 86 into the drum 84 of the laundry machine 80. As shown in FIG. 25, the laundry retrieval device 209 is being removed from the laundry machine 80, leaving the laundry therein.

Figure 30:
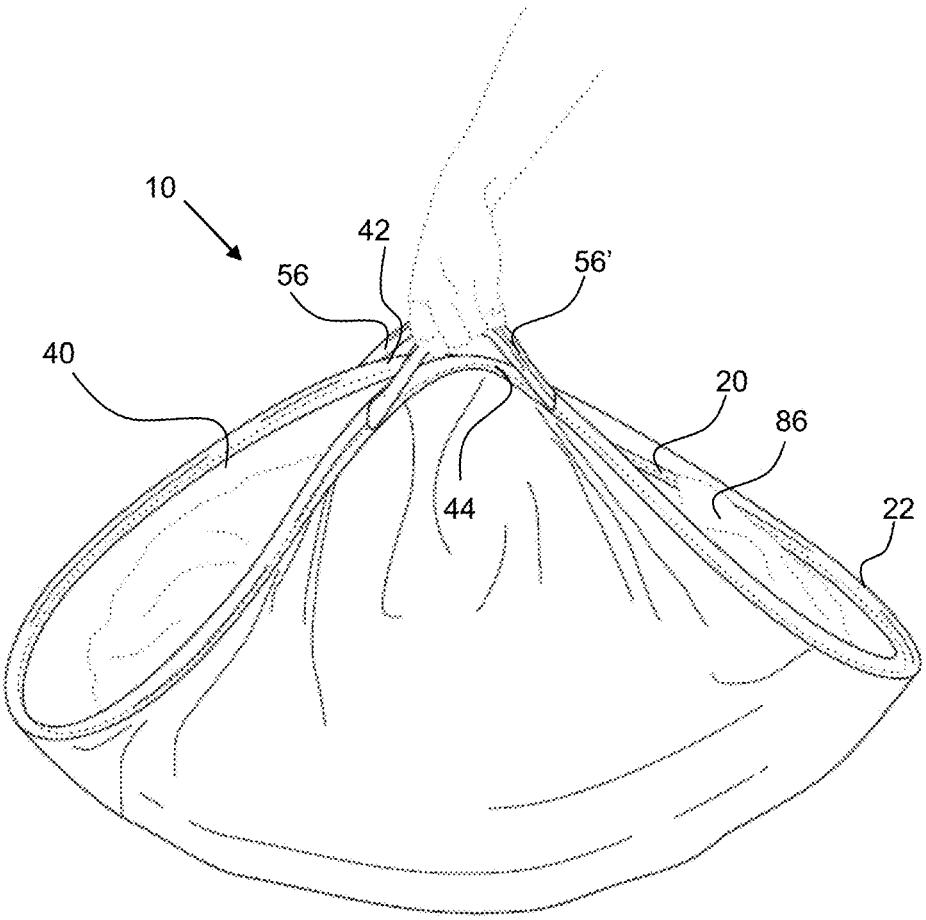
FIG. 30 shows the exemplary laundry retrieval device shown in FIG. 28 with clothes retained on the panel and a person carrying the laundry retrieval device by the two handles.
Figure 31:
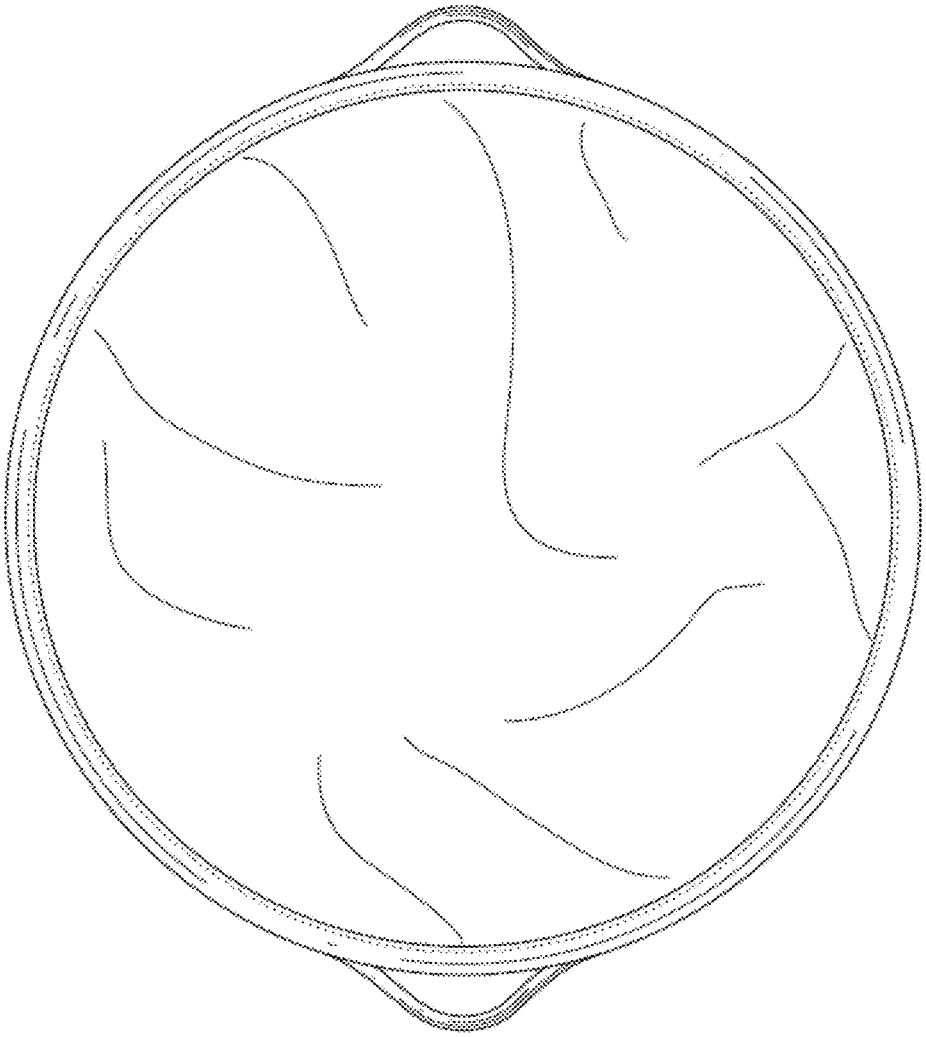
FIG. 31 shows a top view of the laundry retrieval device shown in FIG. 28.
Figure 32:
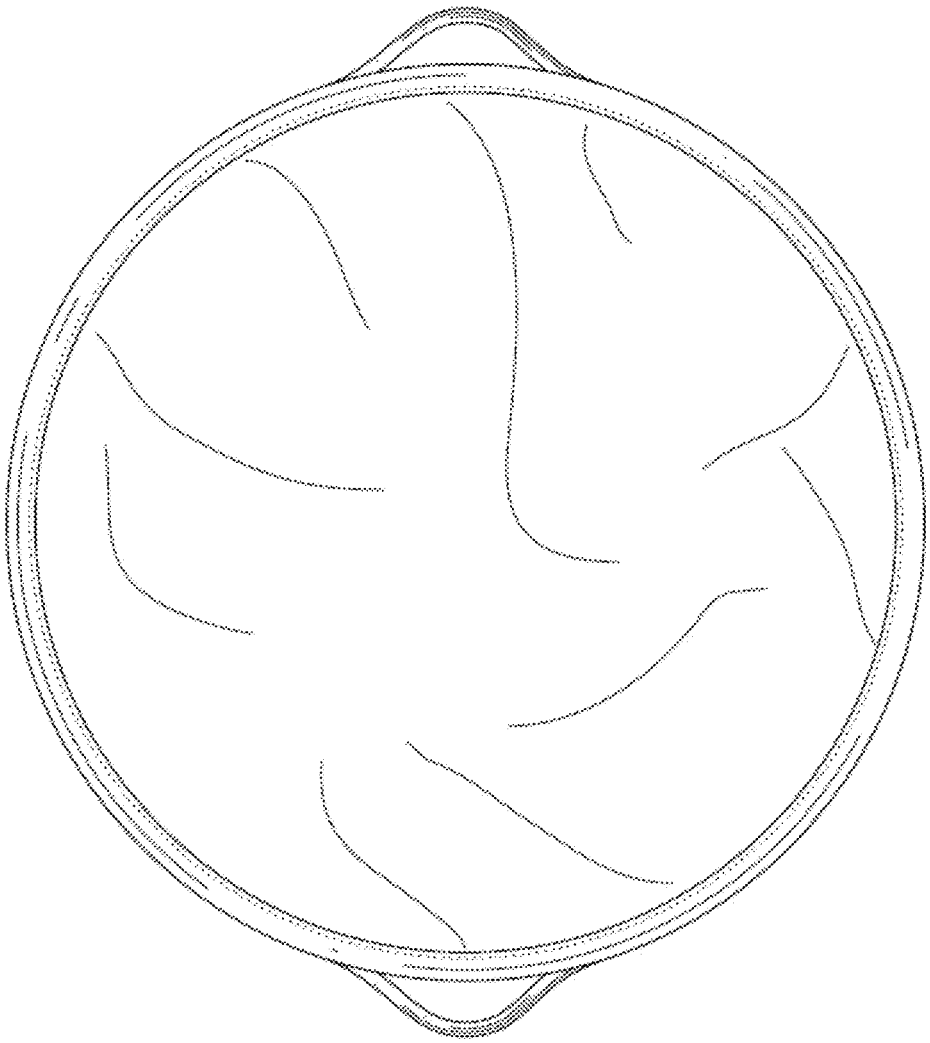
FIG. 32 shows a bottom view of the laundry retrieval device shown in FIG. 28.
Figure 33:
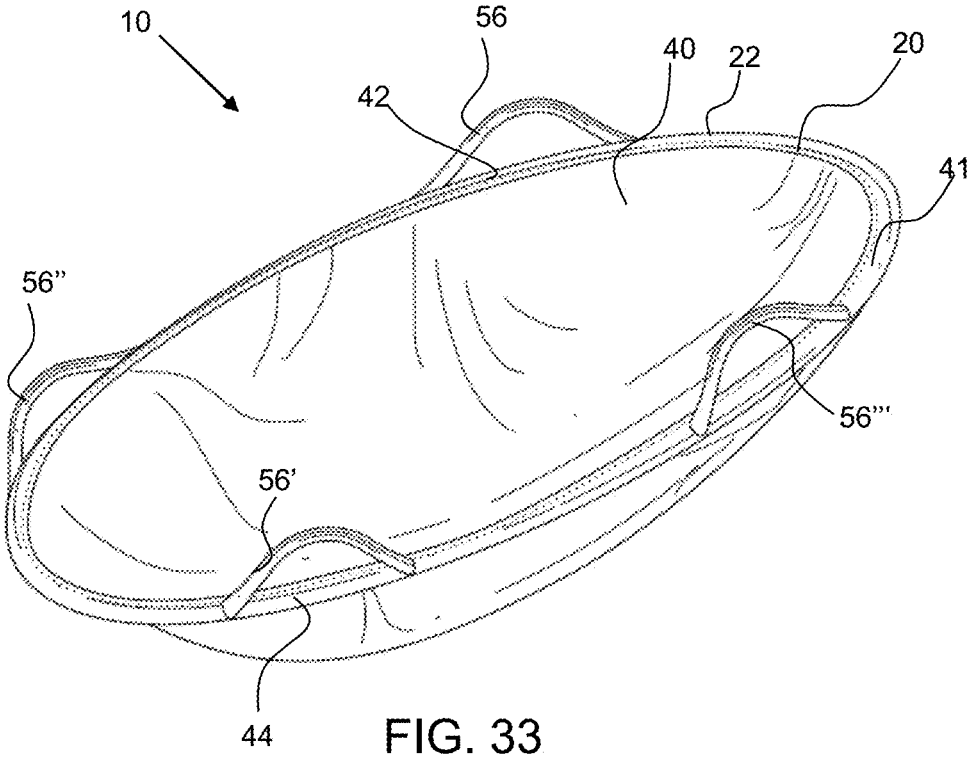
FIG. 33 shows a top side perspective view of an exemplary laundry retrieval device that has a panel extending within a hoop component and having four handles extending from the hoop component and wherein the panel fabric drapes down within the hoop.
Figure 34:
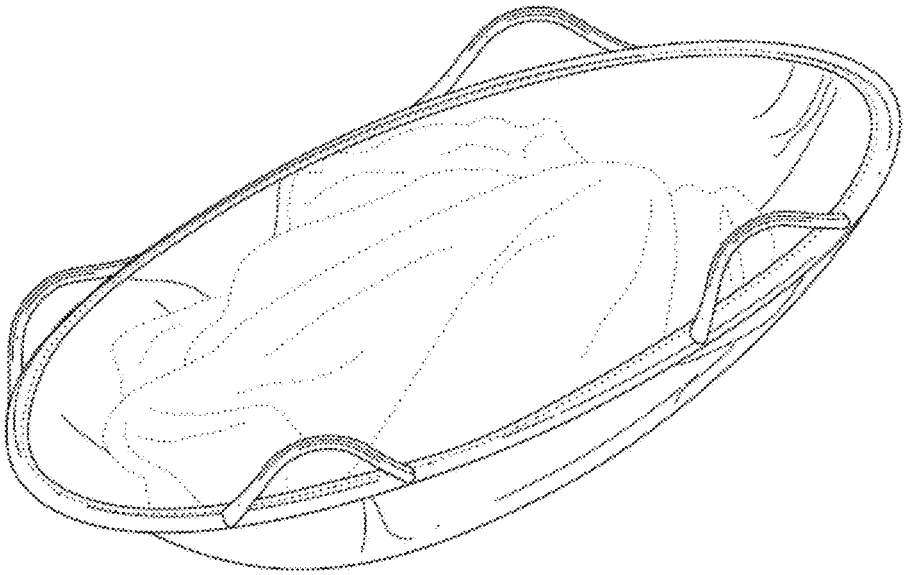
FIG. 34 shows the exemplary laundry retrieval device shown in FIG. 33 with clothes retained on the panel.

Referring now to FIGS. 28 to 32 an exemplary laundry retrieval device 10 has a panel 40 extending within a hoop component 20 and has two loop handles 56, 56'. The handles form loops from the hoop component with two attached ends and a loop of material therebetween. The handles may be plastic and may extend from the hoop component. The handles may be fabric and may extend from the hoop component or from the panel or panel sleeve. The handles may be coupled to the panel, such as being sewn onto the panel or the panel sleeve that extends around the hoop component or may be coupled to the hoop component and the panel sleeve may be discontinuous around the hoop component. The panel fabric drapes down within the hoop As shown in FIG. 30, the loop handles 56, 56' may be used to carry the laundry retrieval device 10 and may bring the first side 42 toward the second side 44 to prevent the laundry 86 from falling out of the panel during transport. The laundry retrieval device 10 is flexible wherein the first side 42 can be folded over to contact the second side 44. Both the hoop component 20 and the panel 40 are flexible.

Figure 35:
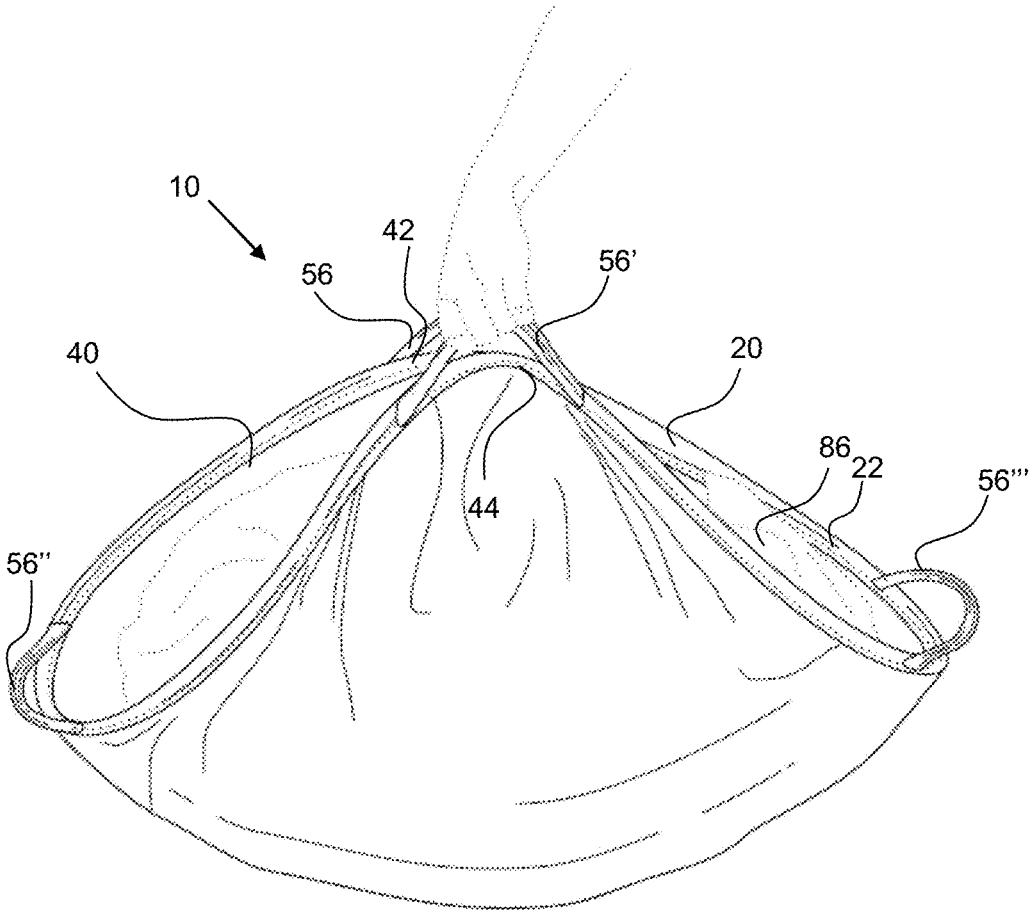
FIG. 35 shows the exemplary laundry retrieval device shown in FIG. 33 with clothes retained on the panel and a person carrying the laundry retrieval device by two of the four handles.
Figure 36:
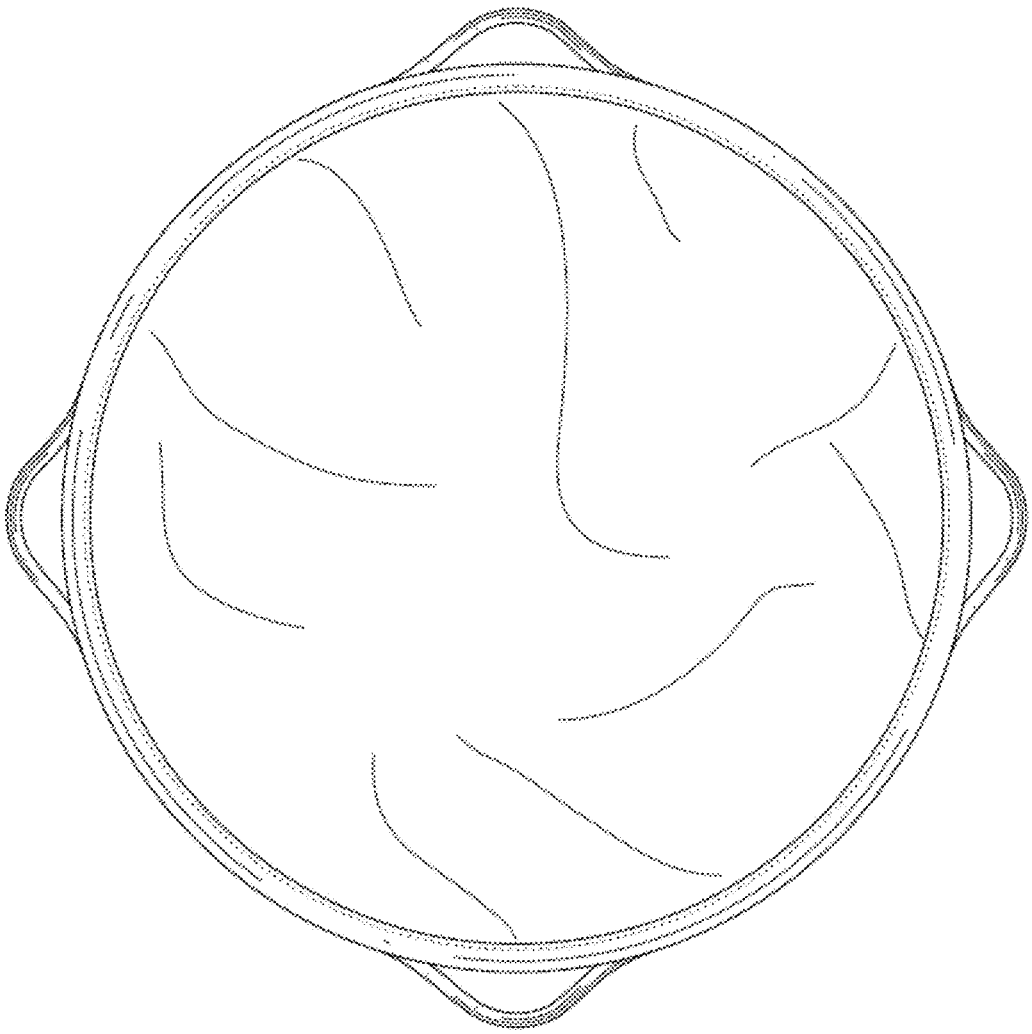
FIG. 36 shows a top view of the laundry retrieval device shown in FIG. 33.
Figure 37:
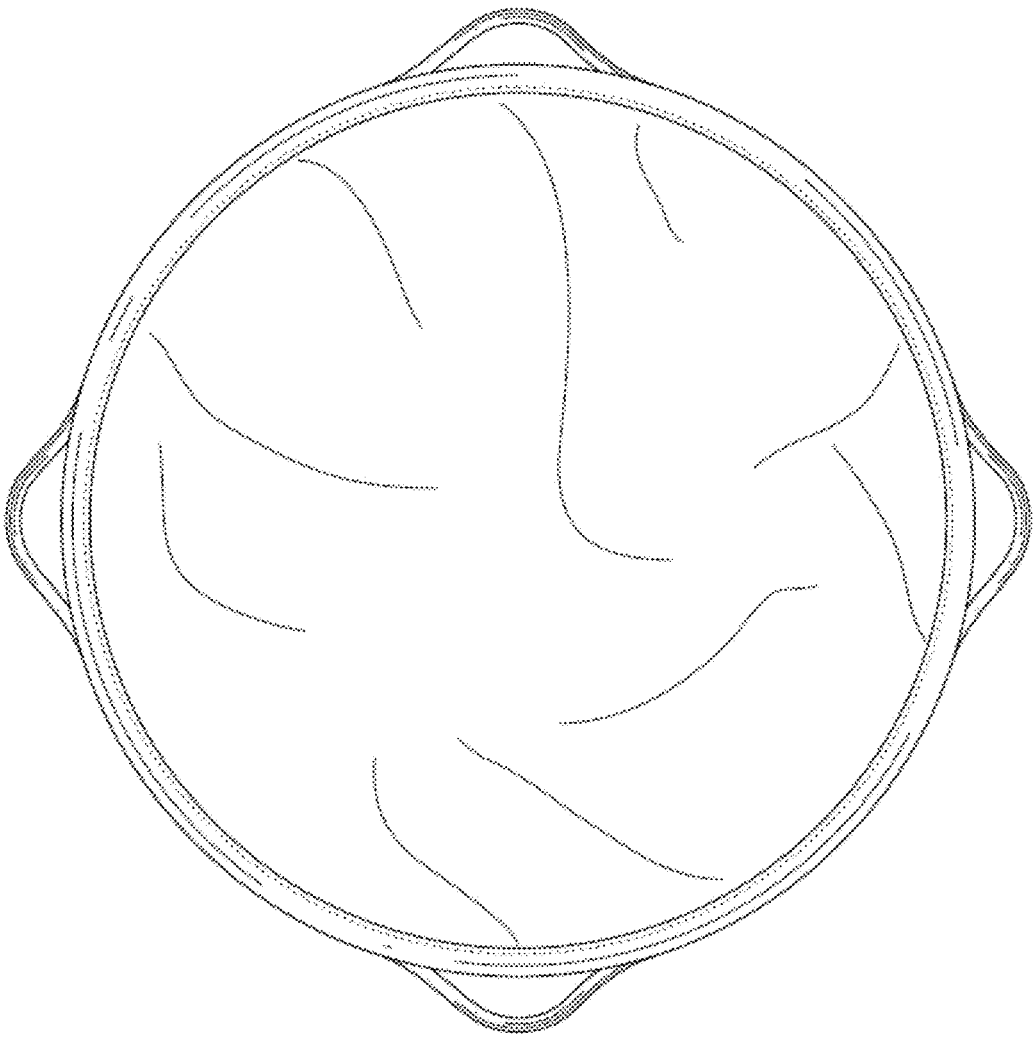
FIG. 37 shows a bottom view of the laundry retrieval device shown in FIG. 33.
Figure 38:
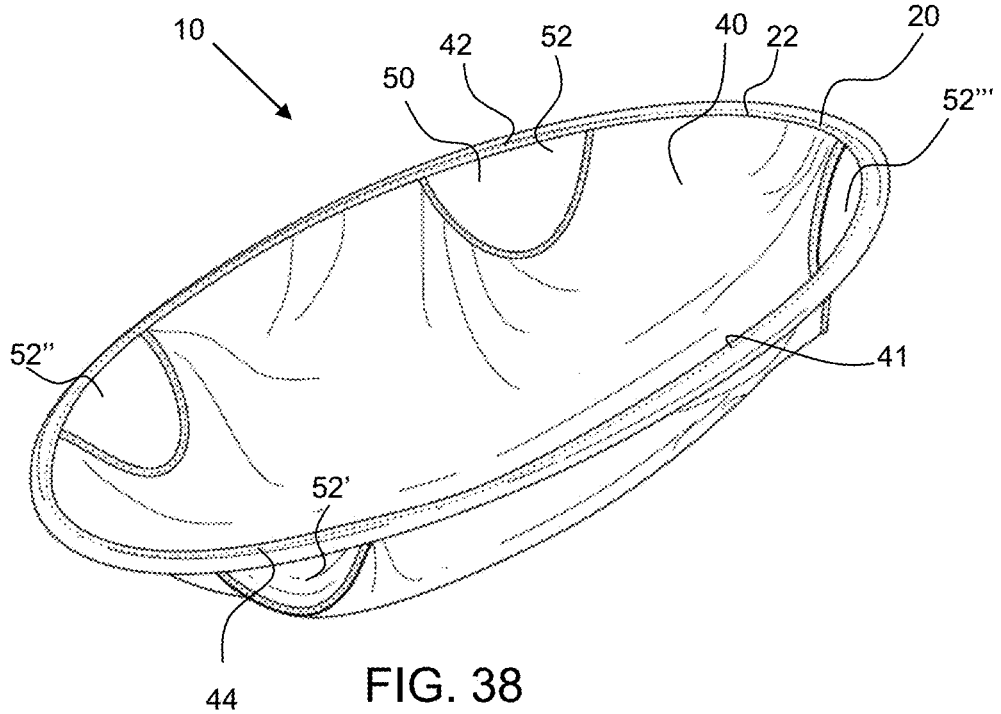
FIG. 38 shows a top side perspective view of an exemplary laundry retrieval device that has a panel extending within a hoop component and having four handles formed between the panel and the hoop component and wherein the panel fabric drapes down within the hoop.
Figure 39:
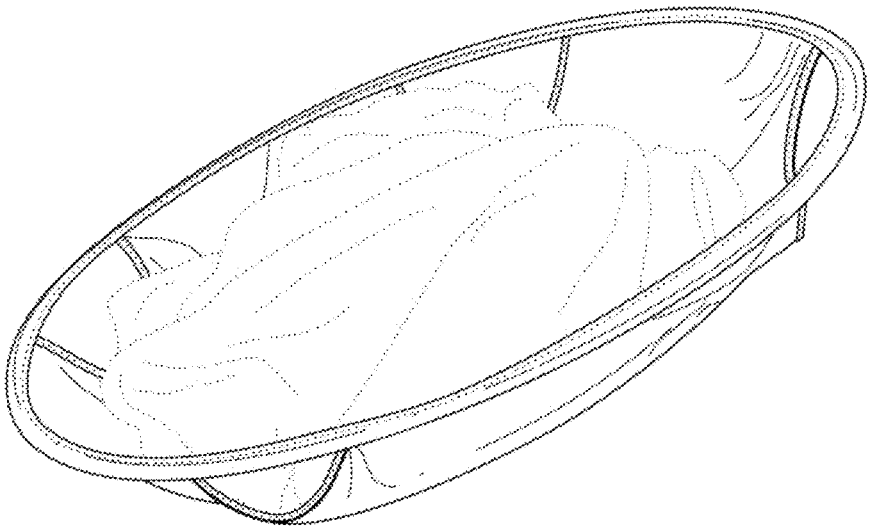
FIG. 39 shows the exemplary laundry retrieval device shown in FIG. 38 with clothes retained on the panel.

Referring now to FIGS. 33 to 37 an exemplary laundry retrieval device 10 has a panel 40 extending within a hoop component 20 and has four loop handles 56, 56', 56", 56'". The handles may extend from the hoop component or from the panel or panel sleeve. The handles may be coupled to the panel, such as being sewn onto the panel or the panel sleeve that extends around the hoop component or may be coupled to the hoop component and the panel sleeve may be discontinuous around the hoop component. The panel fabric drapes down within the hoop As shown in FIG. 35, the loop handles 56, 56' may be used to carry the laundry retrieval device 10 and may bring the first side 42 toward the second side 44 to prevent the laundry 86 from falling out of the panel during transport. The laundry retrieval device 10 is flexible wherein the first side 42 can be folded over to contact the second side 44. Both the hoop component 20 and the panel 40 are flexible.

Figure 40:
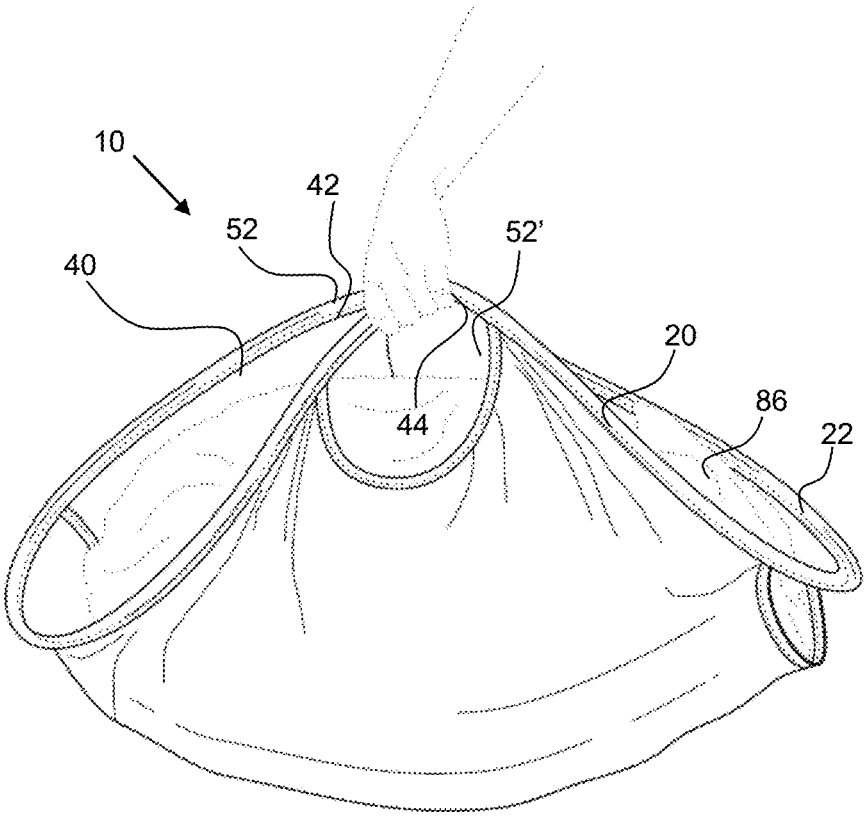
FIG. 40 shows the exemplary laundry retrieval device shown in FIG. 38 with clothes retained on the panel and a person carrying the laundry retrieval device by two of the four handles.
Figure 41:
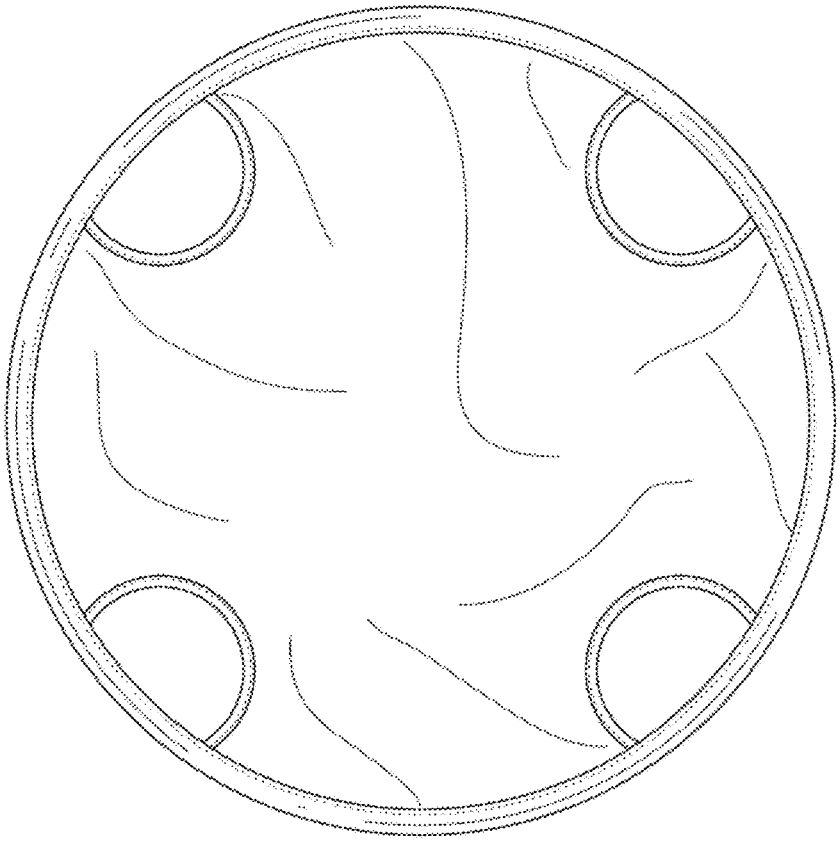
FIG. 41 shows a top view of the laundry retrieval device shown in FIG. 38.
Figure 42:
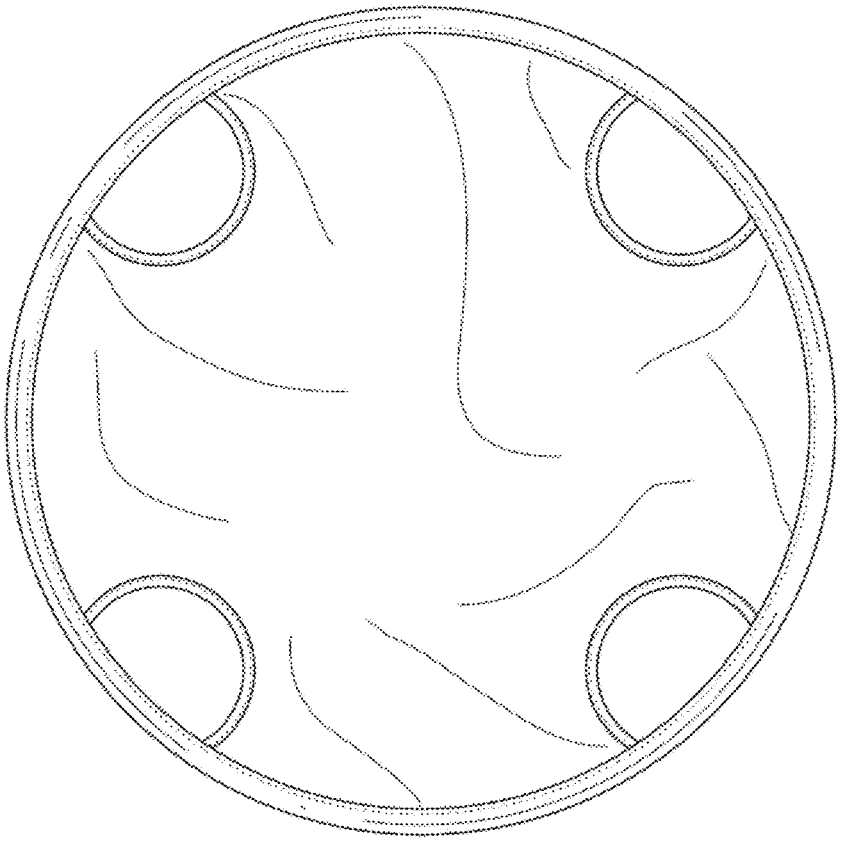
FIG. 42 shows a bottom view of the laundry retrieval device shown in FIG. 38.
Figure 43:
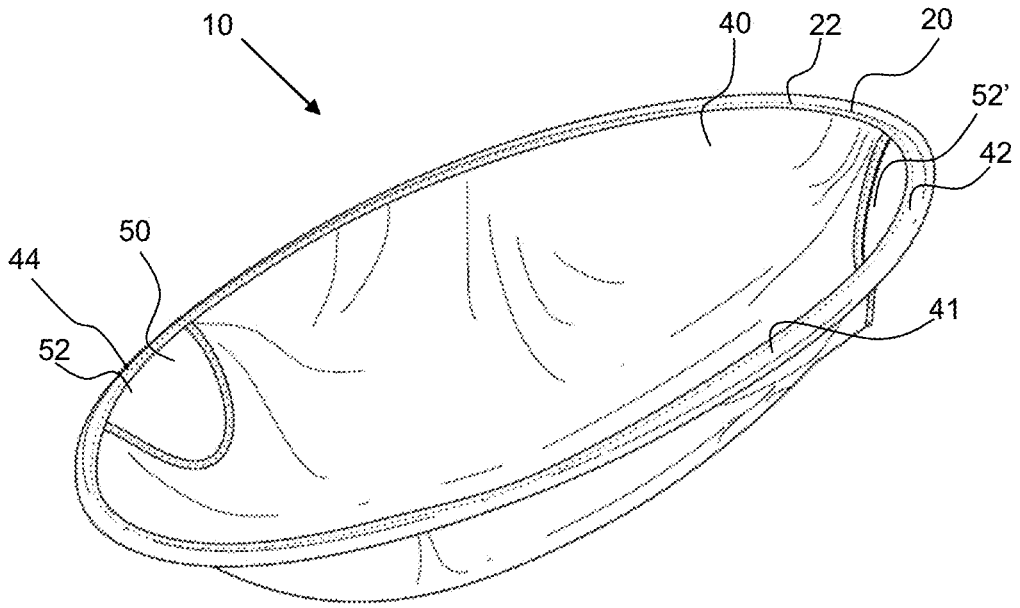
FIG. 43 shows a top side perspective view of an exemplary laundry retrieval device that has a panel extending within a hoop component and having two handles formed between the panel and the hoop component and wherein the panel fabric drapes down within the hoop.
Figure 44:
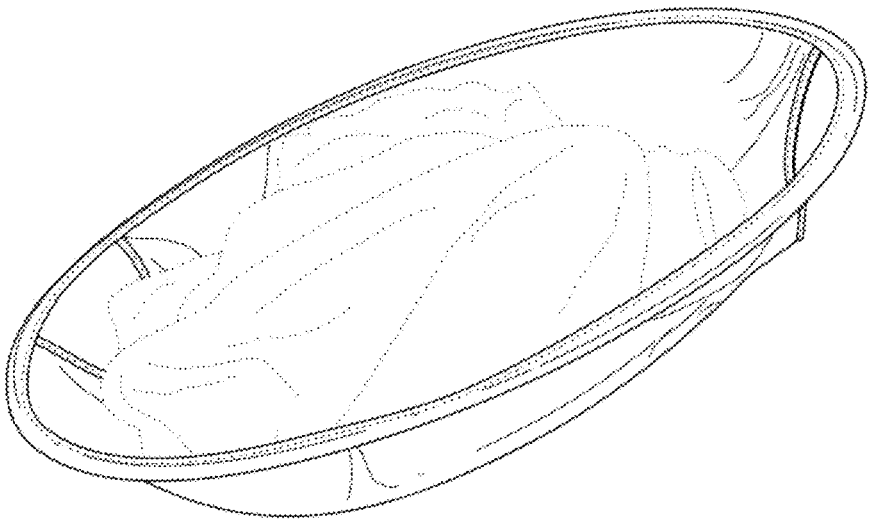
FIG. 44 shows the exemplary laundry retrieval device shown in FIG. 43 with clothes retained on the panel.

Referring now to FIGS. 38 to 42 an exemplary laundry retrieval device 10 has a panel 40 extending within a hoop component 20 and has four handles 52, 52', 52", 52'". The handles are apertures 50 between the hoop component and the panel. A hem may extend along the edge of the handle. The panel sleeve 41 may be continuous around the sleeve or be discontinuous and not extend along the hoop component along the handles. The panel fabric drapes down within the hoop As shown in FIG. 40, the handles 52, 52' may be used to carry the laundry retrieval device 10 and may bring the first side 42 of the laundry retrieval device 10 toward the second side 44 to prevent the laundry 86 from falling out of the panel during transport. The laundry retrieval device 10 is flexible wherein the first side 42 can be folded over to contact the second side 44. Both the hoop component 20 and the panel 40 are flexible.

Referring now to FIGS. 42 to 47 an exemplary laundry retrieval device 10 has a panel 40 extending within a hoop component 20 and has two handles 52, 52'. The handles are apertures 50 between the hoop component and the panel. A hem may extend along the edge of the handle. The panel sleeve 41 may be continuous around the sleeve or be discontinuous and not extend along the hoop component along the handles. The panel fabric drapes down within the hoop.

Figure 45:
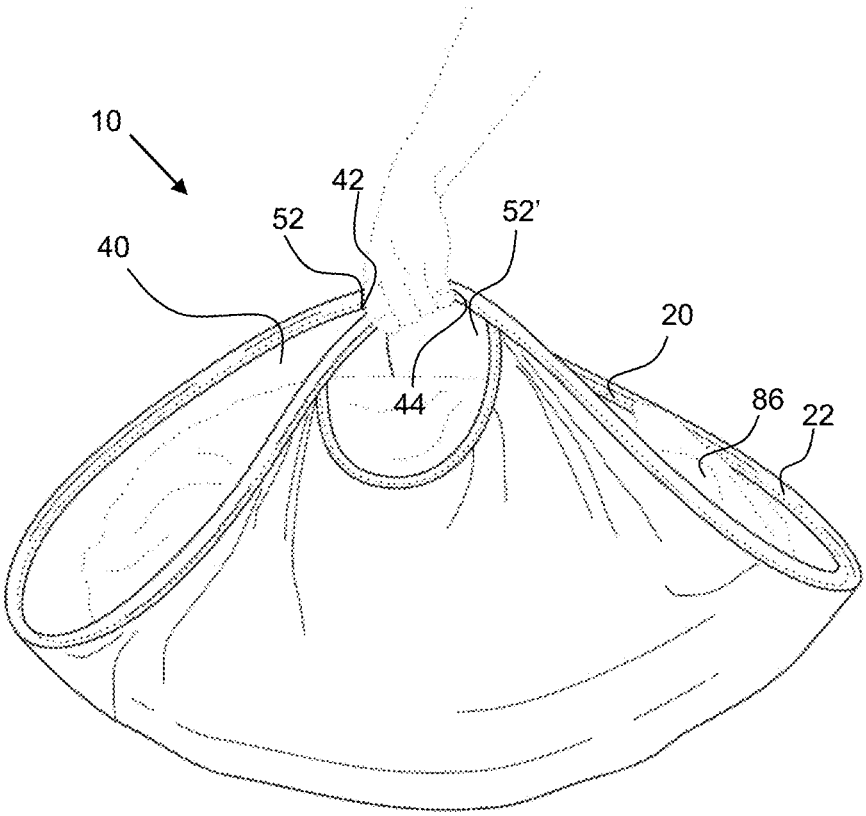
FIG. 45 shows the exemplary laundry retrieval device shown in FIG. 43 with clothes retained on the panel and a person carrying the laundry retrieval device by the two handles.
Figure 46:
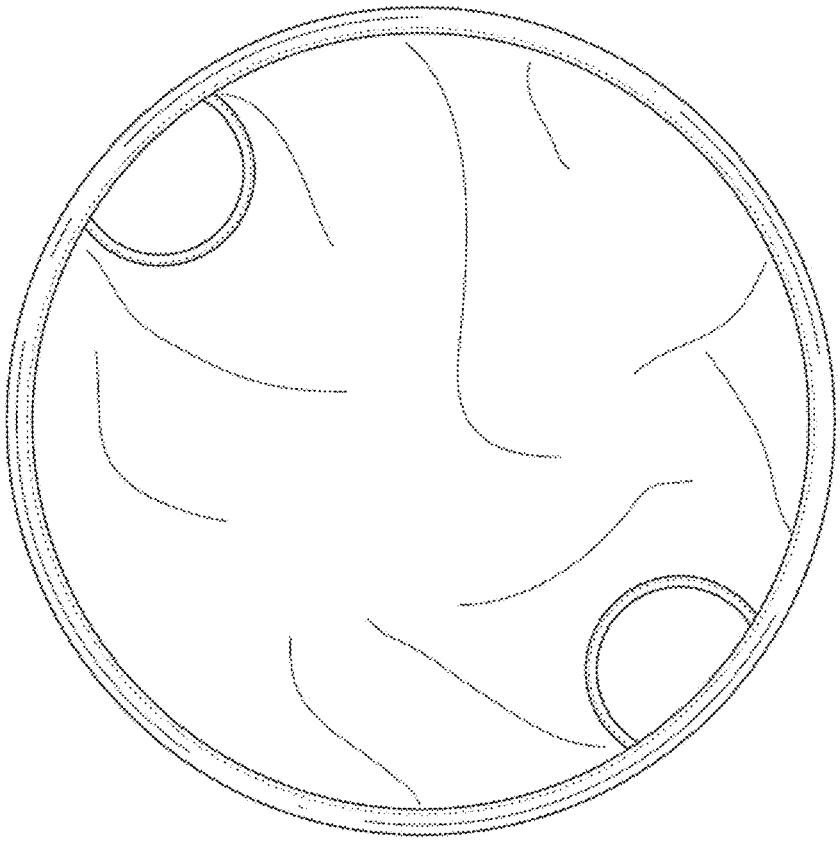
FIG. 46 shows a top view of the laundry retrieval device shown in FIG. 43.
Figure 47:
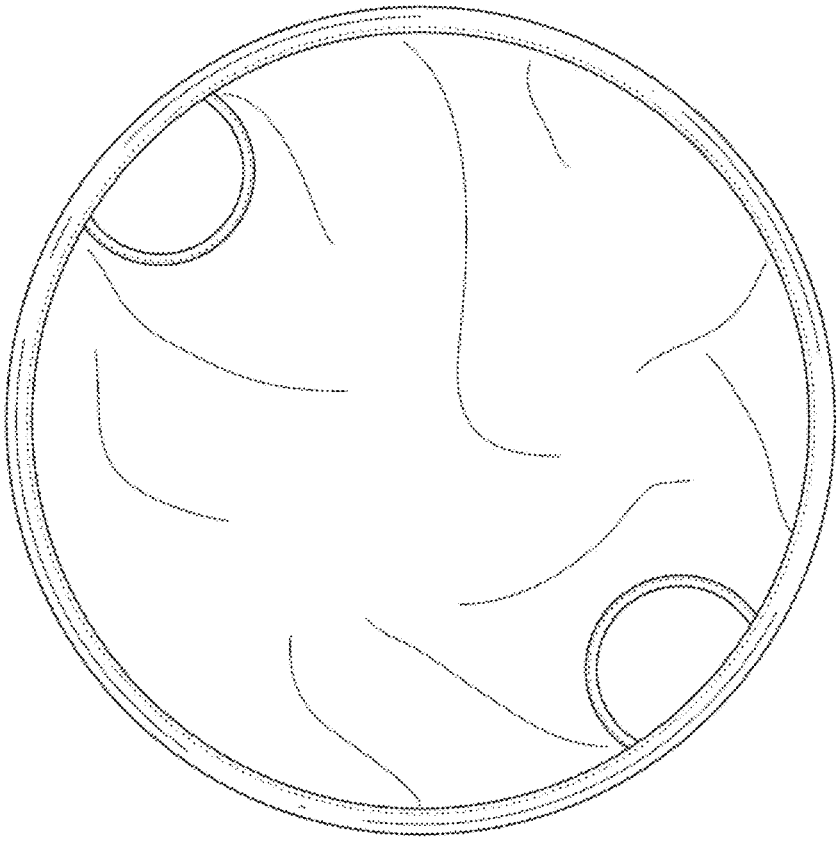
FIG. 47 shows a bottom view of the laundry retrieval device shown in FIG. 43.
Figure 48:
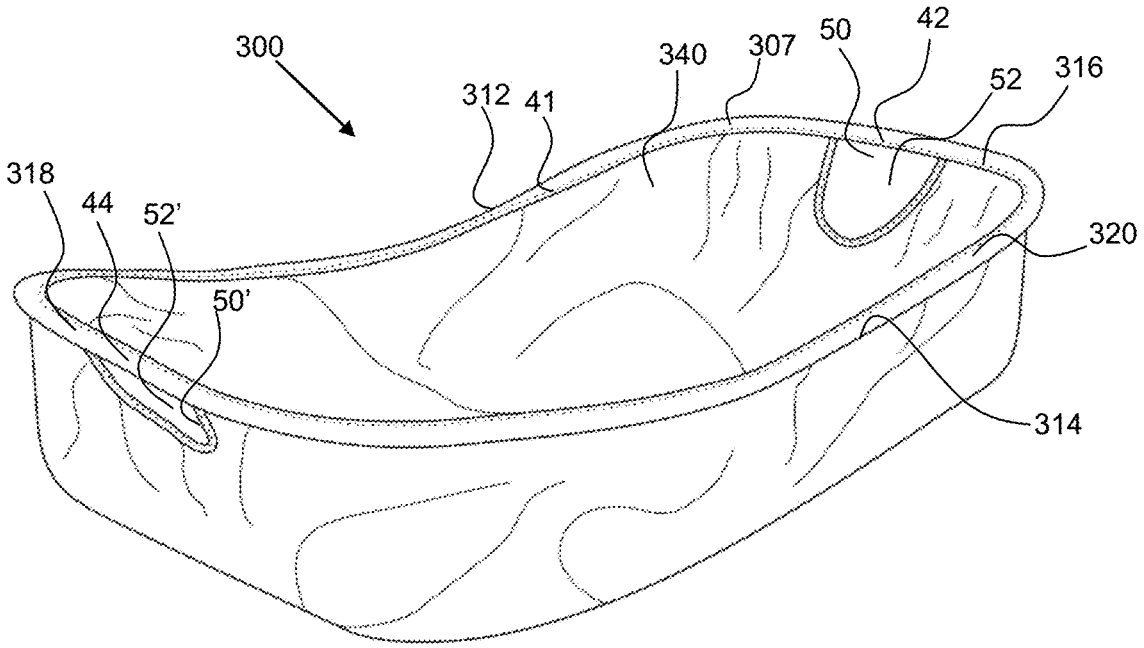
FIG. 48 shows a top side perspective view of an exemplary laundry retrieval device that has a panel extending within a rectangularly shaped hoop component and having two handles formed between the panel and the hoop component on opposing ends of the laundry retrieval device and wherein the panel fabric drapes down within the hoop.
Figure 49:
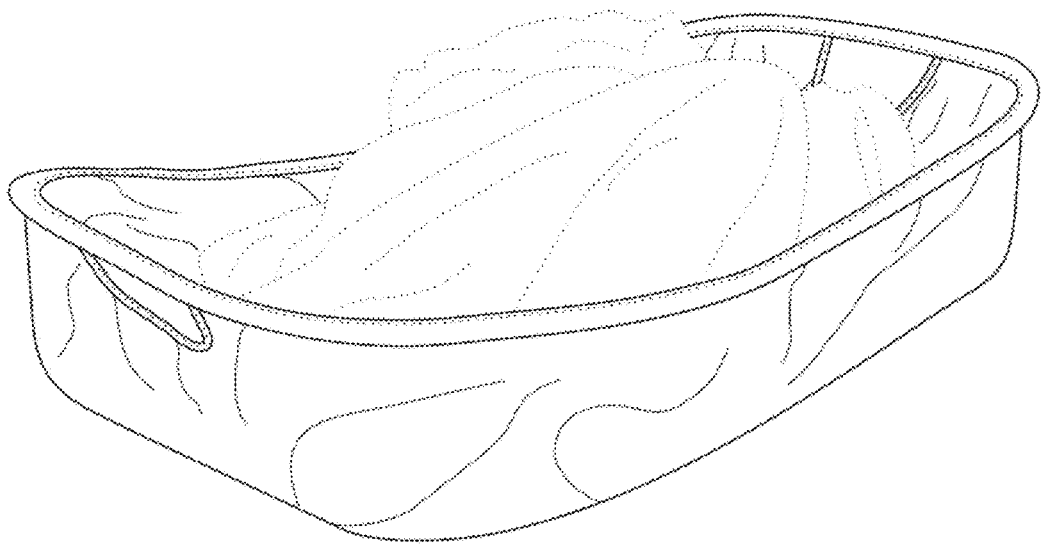
FIG. 49 shows the exemplary laundry retrieval device shown in FIG. 48 with clothes retained on the panel.

As shown in FIG. 45, the handles 52, 52' may be used to carry the laundry retrieval device 10 and may bring the first side 42 of the laundry retrieval device 10 toward the second side 44 to prevent the laundry 86 from falling out of the panel during transport. The laundry retrieval device 10 is flexible wherein the first side 42 can be folded over to contact the second side 44. Both the hoop component 20 and the panel 40 are flexible.

Figure 50:
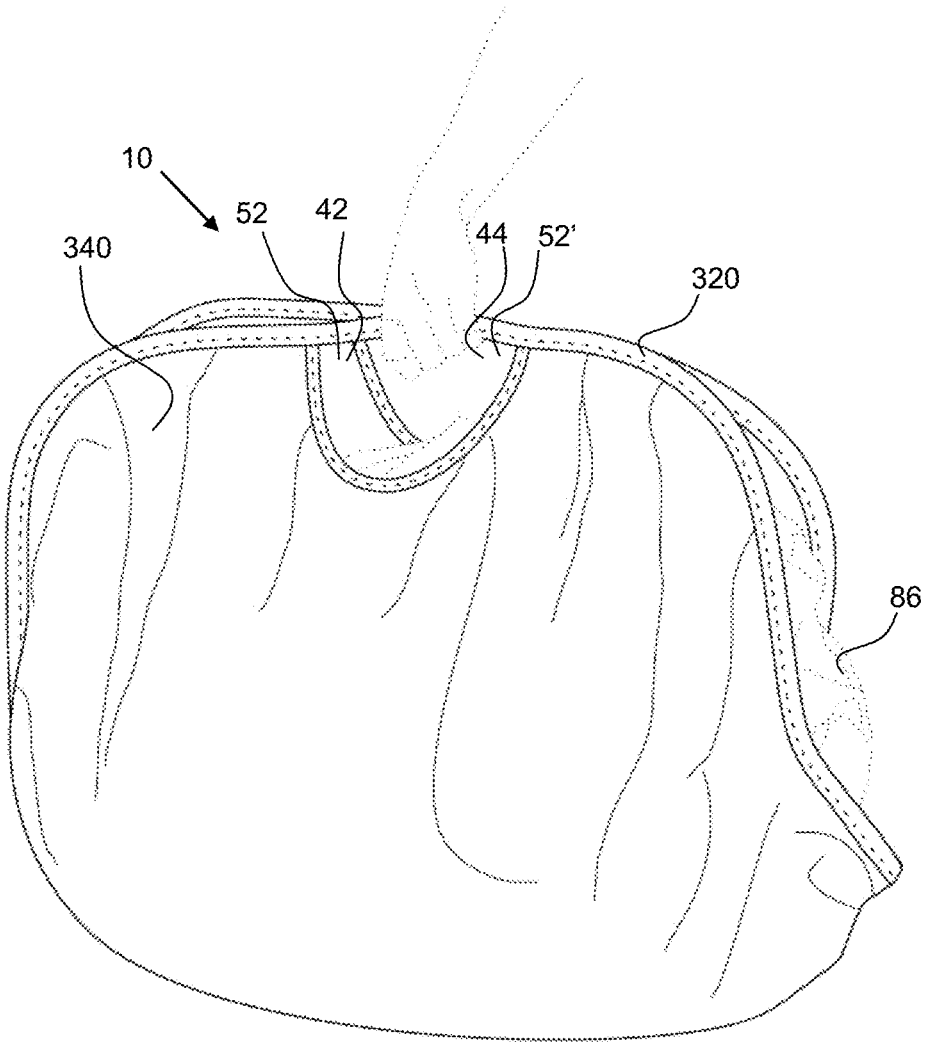
FIG. 50 shows the exemplary laundry retrieval device shown in FIG. 48 with clothes retained on the panel and a person carrying the laundry retrieval device by the two handles with the panel and hoop component folded over to bring the two ends of the laundry retrieval device together.
Figure 51:
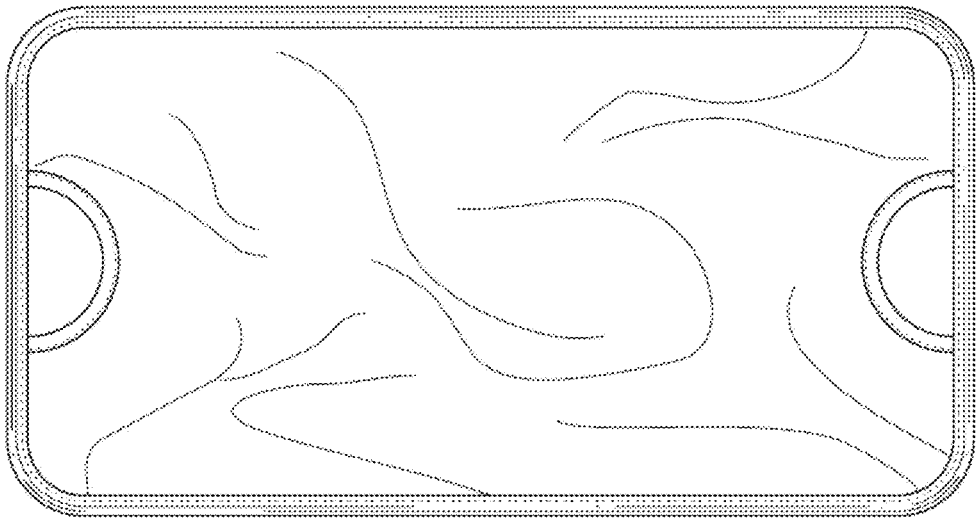
FIG. 51 shows a top view of the laundry retrieval device shown in FIG. 48.
Figure 52:
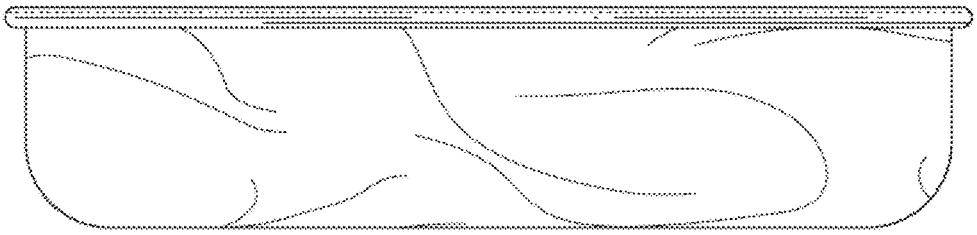
FIG. 52 shows a side view of the laundry retrieval device shown in FIG. 48.
Figure 53:
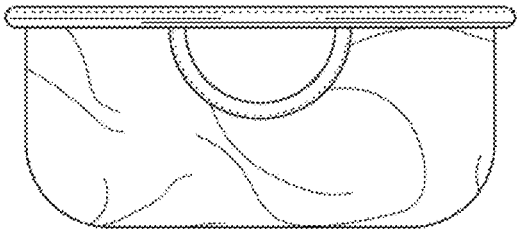
FIG. 53 shows an end view of the laundry retrieval device shown in FIG. 48.
Figure 54:
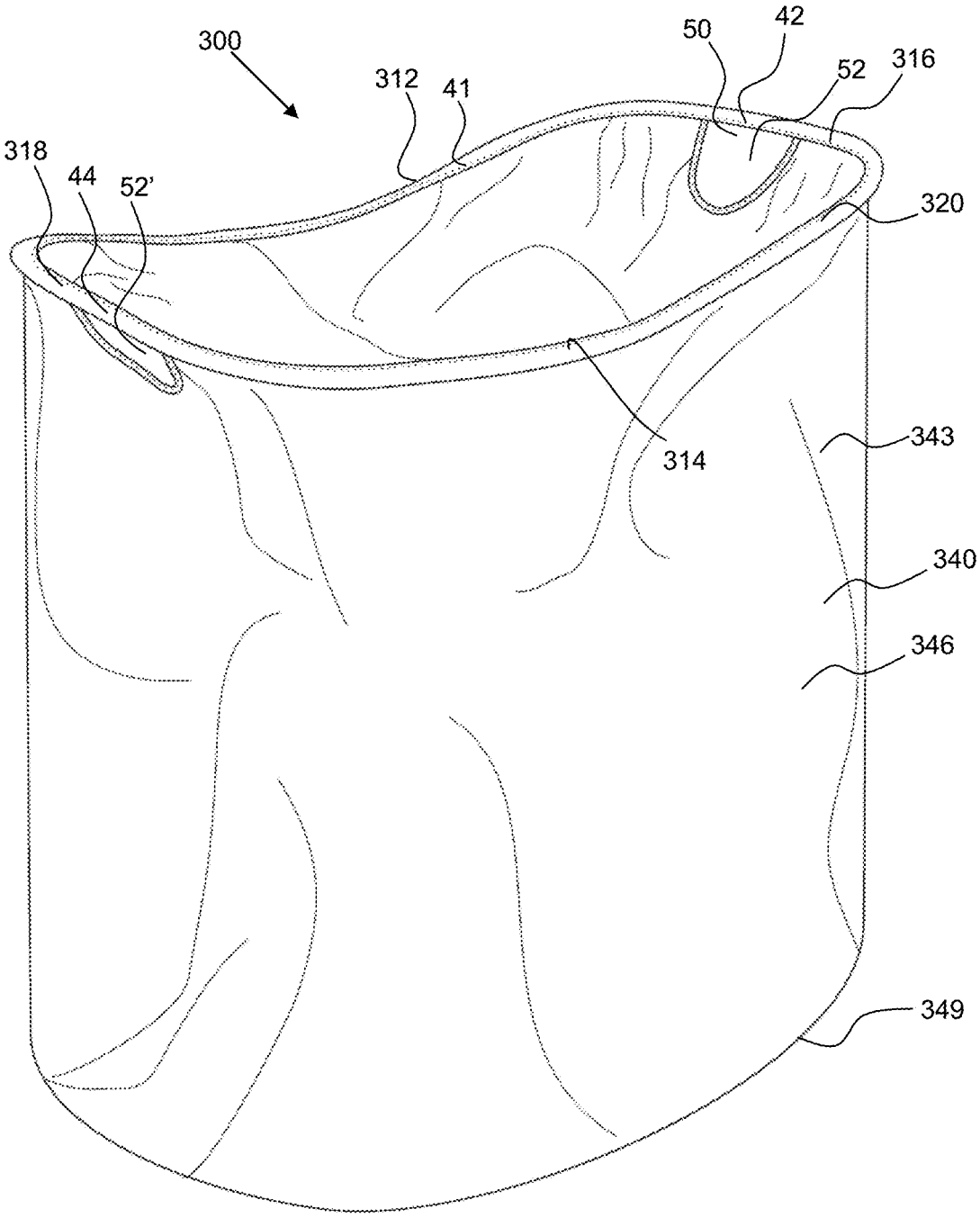
FIG. 54 shows a top side perspective view of an exemplary laundry retrieval device that has a panel extending down from a rectangularly shaped hoop component and having two handles formed between the panel and the hoop component on opposing ends of the laundry retrieval device and wherein the panel fabric drapes down within the hoop.
Figure 55:
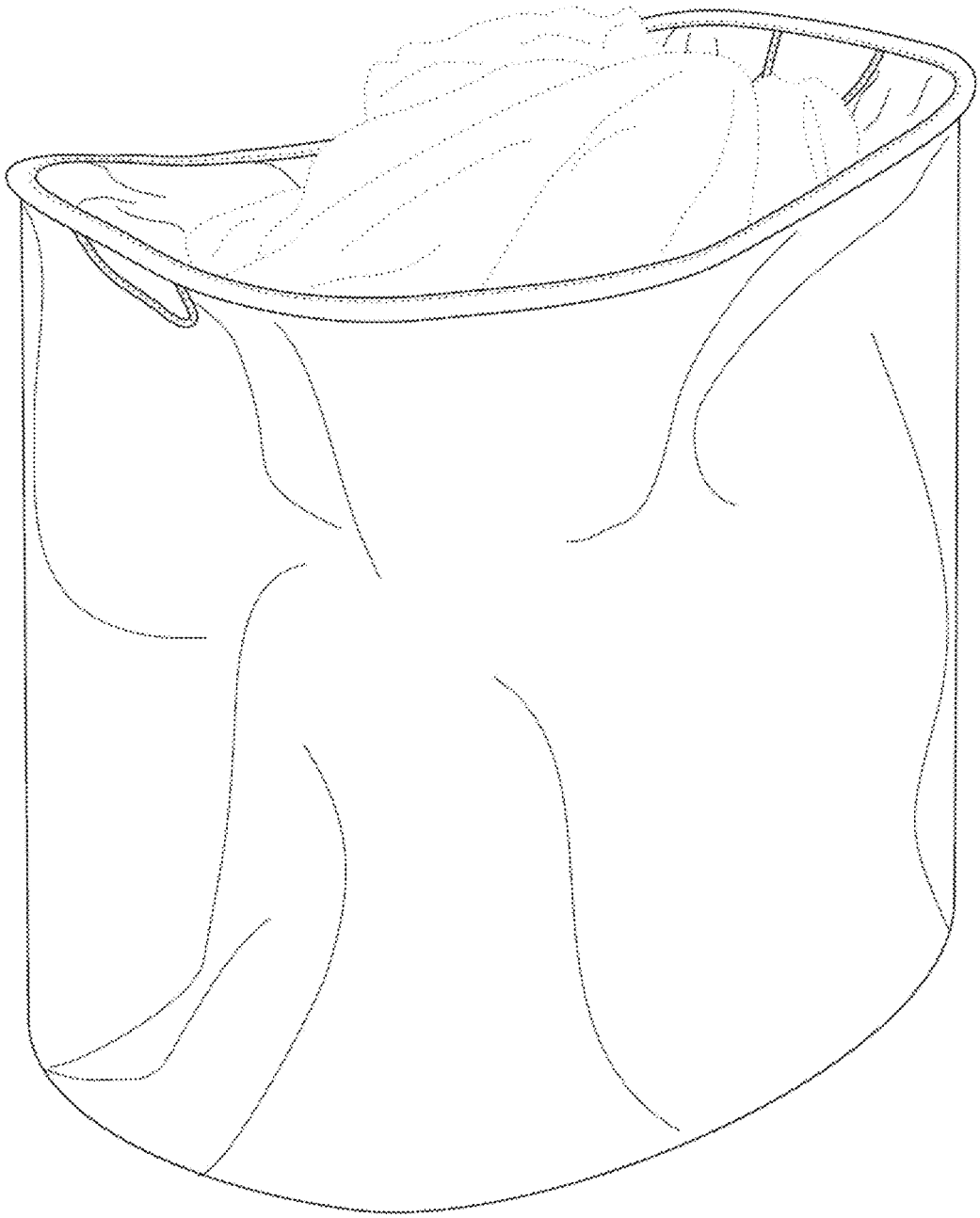
FIG. 55 shows the exemplary laundry retrieval device shown in FIG. 54 with clothes retained on the panel.

Referring now to FIGS. 48 to 52 an exemplary laundry retrieval device 300 has a panel 40 extending within a hoop component 20 and has two handles 52, 52'. The handles are apertures 50 between the hoop component and the panel. A hem may extend along the edge of the handle. The panel sleeve 41 may be continuous around the sleeve or be discontinuous and not extend along the hoop component along the handles. The panel fabric drapes down within the hoop. The hoop component 20 and the laundry retrieval device 300 has a rectangular shape with two long sides 312, 314 and two ends 316, 318, wherein the ends are shorter than the sides. The sides may be a factor longer than the ends such as about 1.25 or more, about 1.5 or more, about 1.75 or more, about 2.0 or more, about 2.5 or more, about 3.0 or more and any range between and including the factors provided. As best shown in FIG. 51, the hoop component is rectangular or extends in a rectangular shape having two parallel sides and two parallel ends and corners that are curved about a radius of curvature.

The hoop component comprises a ring 307 that has an outer perimeter forming rectangular shape. The two apertures 50, 50' form handles 52, 52', between the panel 340 and the ring 307 or hoop component 320. The handles may be configured across the hoop component from each other, centrally located along the opposing ends.

As shown in FIG. 50, the handles 52, 52' may be used to carry the laundry retrieval device 10 and may bring the first side 42 toward the second side 44 to prevent the laundry 86 from falling out of the panel during transport. The laundry retrieval device 10 is flexible wherein the first side 42 can be folded over to contact the second side 44. Both the hoop component 20 and the panel 40 are flexible.

Referring now to FIGS. 54 to 59 an exemplary laundry retrieval device 300 has a panel 340 extending within a hoop component 320 and has two handles 52, 52'. The handles are apertures 50 between the hoop component and the panel. A hem may extend along the edge of the handle. The panel sleeve 41 may be continuous around the sleeve or be discontinuous and not extend along the hoop component along the handles. A panel sack 343 that extends down from the hoop component to form a panel receptacle 346. The panel sack 343 extends from the hoop component down to the base 349 of the panel sack.

The hoop component 320 and the opening of the laundry retrieval device 300 has a rectangular shape with two long sides 312, 314 and two ends 316, 318, wherein the ends are shorter than the sides. The sides may be a factor longer than the ends such as about 1.25 or more, about 1.5 or more, about 1.75 or more, about 2.0 or more, about 2.5 or more, about 3.0 or more and any range between and including the factors provided.

Figure 56:
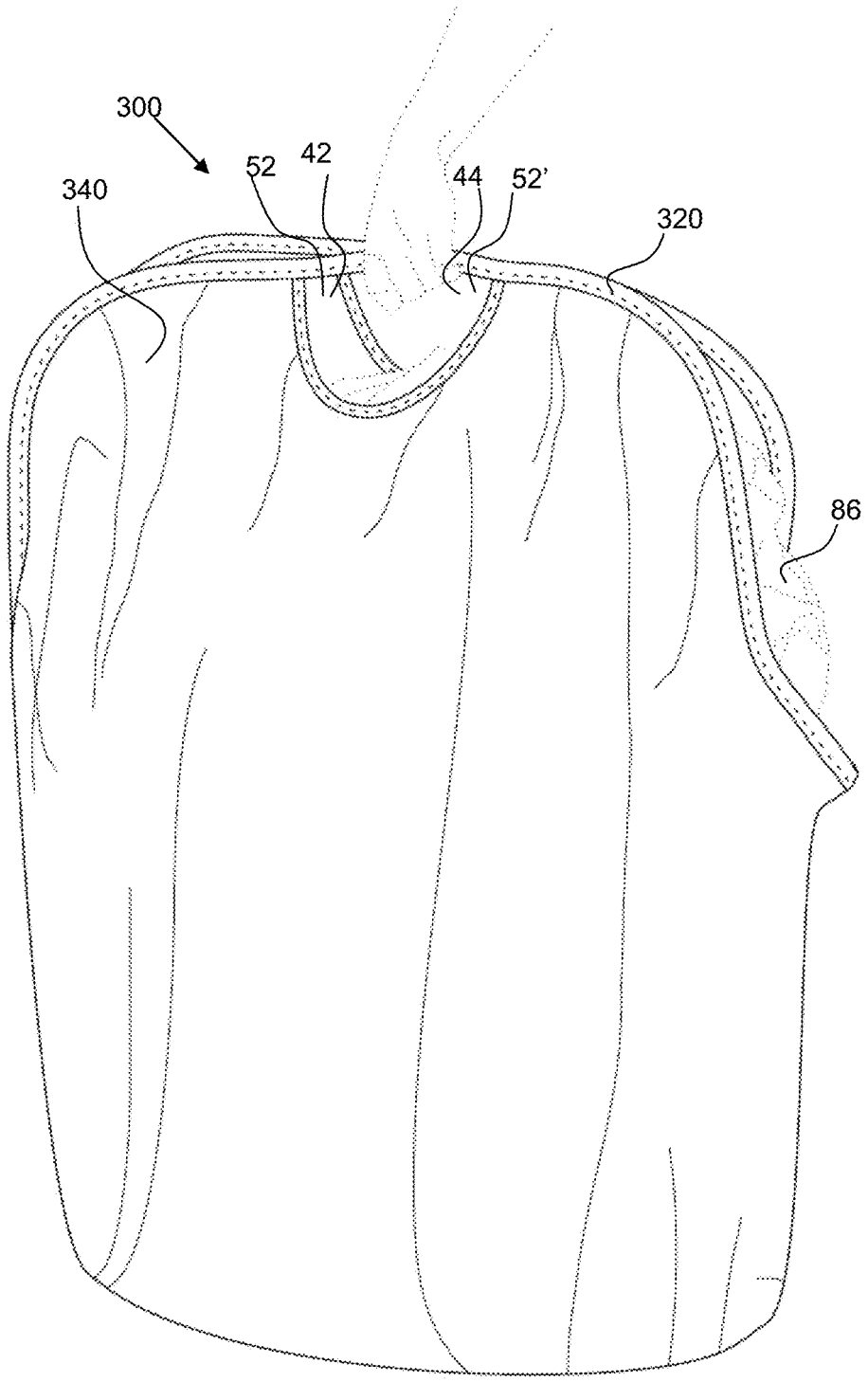
FIG. 56 shows the exemplary laundry retrieval device shown in FIG. 54 with clothes retained on the panel and a person carrying the laundry retrieval device by the two handles with the panel and hoop component folded over to bring the two ends of the laundry retrieval device together.
Figure 57:
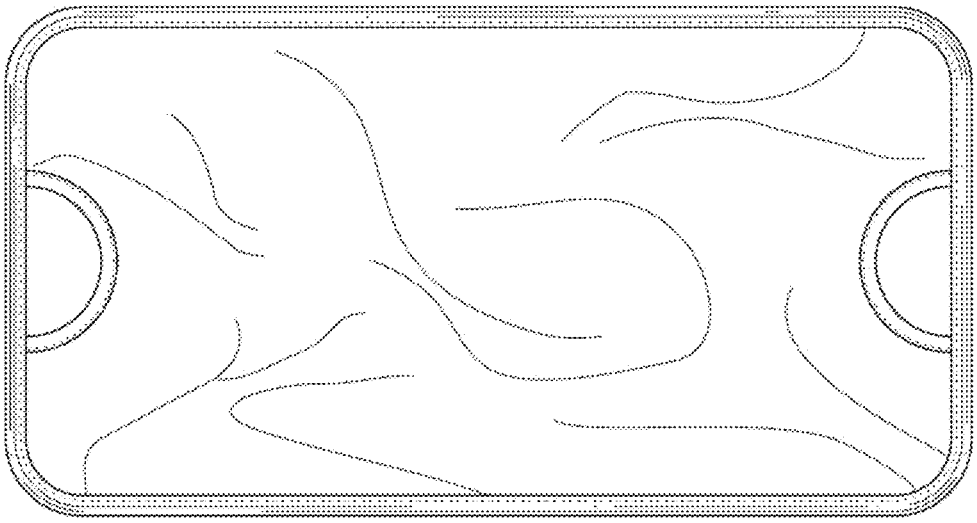
FIG. 57 shows a top view of the laundry retrieval device shown in FIG. 54.
Figure 58:
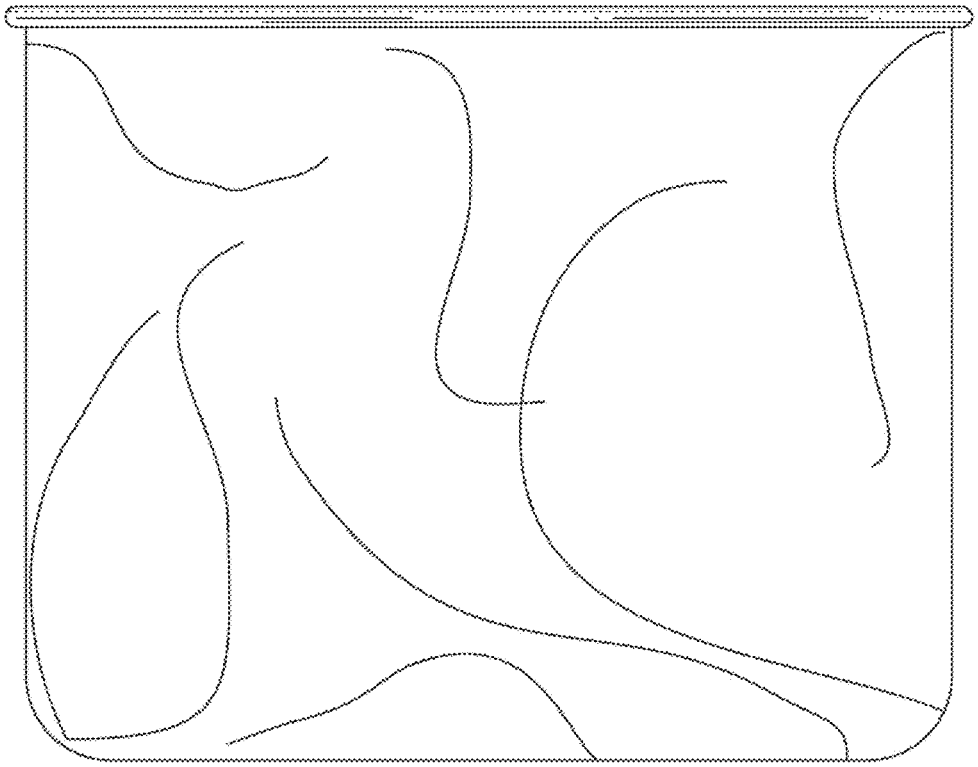
FIG. 58 shows a side view of the laundry retrieval device shown in FIG. 54.
Figure 59:
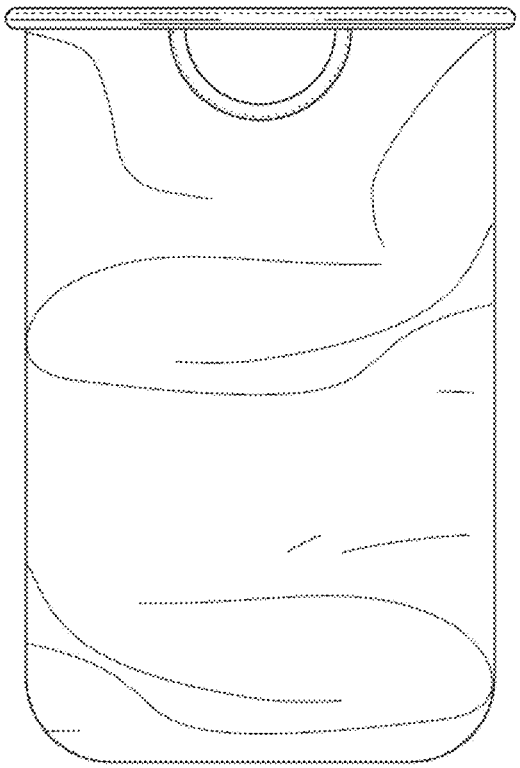
FIG. 59 shows an end view of the laundry retrieval device shown in FIG. 54.

As shown in FIG. 56, the handles 52, 52' may be used to carry the laundry retrieval device 300 and may bring the first side 42 toward the second side 44 to prevent the laundry 86 from falling out of the panel during transport. The laundry retrieval device 300 is flexible wherein the first side 42 can be folded over to contact the second side 44. Both the hoop component 20 and the panel 340 are flexible.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A laundry retrieval device comprising:

a) a hoop component that is resilient and flexible;

wherein the hoop forms a perimeter around an opening to the laundry retrieval device, and wherein a hoop area is formed within said perimeter; and b) a panel extending within from the hoop component and coupled to the hoop component;

wherein the panel is a fabric that is larger in area than said hoop area of the hoop component by at least 20%;

wherein the hoop component is configured for insertion into a laundry machine through a door opening of the laundry machine and into a drum of the laundry machine above laundry in said laundry machine;

whereby rotating said drum of the laundry machine positions said laundry above the laundry retrieval device to cause the laundry to fall onto the panel of the laundry retrieval device; and wherein the laundry retrieval device is configured to bend by folding to configure the laundry retrieval device around the laundry contained thereon for removal of the laundry retrieval device from the laundry machine;

wherein the hoop component has a first extension coupled to a first hinge and a second hinge and wherein the first extension is configured to pivot about said first hinge and said second hinge, and wherein the hoop component is configured for insertion into the laundry machine by pivoting the first extension toward an opposing side of the hoop component.

2. The laundry retrieval device of claim 1, wherein the hoop component has a second extension and wherein the first extension is configured to pivot about the first hinge and the second hinge to bring toward the second extension; and wherein the hoop component is configured for insertion into the laundry machine by pivoting the first extension toward the second extension.

3. The laundry retrieval device of claim 2, wherein with the first extension pivoted to the second extension, the laundry retrieval device forms an enclosure around laundry configured within the panel.

4. The laundry retrieval device of claim 2, wherein the hoop component extends in a circle forming a circular opening to the laundry retrieval device.

5. The laundry retrieval device of claim 4, wherein the first extension extends substantially 180 degrees of the hoop component, within 10 degrees of 180 degrees.

6. The laundry retrieval device of claim 5, wherein the second extension is configured to pivot about the first hinge and the second hinge.

7. The laundry retrieval device of claim 6, wherein the panel forms a panel sack wherein the panel is a fabric is larger in area than said hoop area of the hoop component by at least 100%.

8. The laundry retrieval device of claim 7, wherein the panel sack has a sack length from the hoop component of 50 cm or more.

9. The laundry retrieval device of claim 1, wherein the panel forms a panel sack wherein the panel is a fabric that is larger in area than said hoop area of the hoop component by at least 100%.

10. The laundry retrieval device of claim 9, wherein the panel sack has a sack length from the hoop component of 50 cm or more.

11. The laundry retrieval device of claim 2, wherein the hoop component extends in a rectangle forming a rectangular opening to the laundry retrieval device.

12. The laundry retrieval device of claim 11, wherein the panel forms a panel sack wherein the panel is a fabric is larger in area than said hoop area of the hoop component by at least 100%.

13. The laundry retrieval device of claim 12, wherein the panel sack has a sack length from the hoop component of 20 cm or more.

14. The laundry retrieval device of claim 12, wherein the panel sack has a sack length from the hoop component of 50 cm or more.

15. The laundry retrieval device of claim 1, further comprising handles formed by apertures between the panel and the hoop component.

16. The laundry retrieval device of claim 15, comprising two handles.

17. The laundry retrieval device of claim 1, wherein the panel is an elastic fabric having an elongation of at least 50% at 70% of max load.

* * * * *